US011827016B2

(12) United States Patent
Watanabe et al.

(10) Patent No.: US 11,827,016 B2
(45) Date of Patent: Nov. 28, 2023

(54) LIQUID EJECTING APPARATUS

(71) Applicant: SEIKO EPSON CORPORATION, Tokyo (JP)

(72) Inventors: Eiichiro Watanabe, Matsumoto (JP); Hiroaki Okui, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 13 days.

(21) Appl. No.: 17/662,919

(22) Filed: May 11, 2022

(65) Prior Publication Data

US 2022/0363055 A1 Nov. 17, 2022

(30) Foreign Application Priority Data

May 14, 2021 (JP) ..... 2021-082070

(51) Int. Cl.
*B41J 2/14* (2006.01)
*B41J 2/175* (2006.01)

(52) U.S. Cl.
CPC ..... *B41J 2/14* (2013.01); *B41J 2/175* (2013.01); *B41J 2202/12* (2013.01)

(58) Field of Classification Search
CPC . B41J 2/14; B41J 2/175; B41J 2202/12; B41J 2002/14338; B41J 2002/14419; B41J 2/14233; B41J 2202/11; B41J 2202/19; B41J 2202/20; B41J 2/07; B41J 2/04501
See application file for complete search history.

(56) References Cited

U.S. PATENT DOCUMENTS

2010/0238238 A1 9/2010 Yamamoto
2013/0233939 A1 9/2013 Uezawa

FOREIGN PATENT DOCUMENTS

JP 2010-214847 A 9/2010
JP 2013-184372 A 9/2013

OTHER PUBLICATIONS

"Liquid Ejecting Head and Liquid Ejecting Device" to Kinoshita, Ryota (CN 111660670 A), Sep. 15, 2020, [see First Embodiment and Figs. 4-5]. (Year: 2020).*

* cited by examiner

*Primary Examiner* — Lisa Solomon
(74) *Attorney, Agent, or Firm* — WORKMAN NYDEGGER

(57) ABSTRACT

The control section sets, as a first flow rate, a flow rate of the liquid, which is circulated by the circulating mechanism, per unit time, during an ejection operation of ejecting the liquid from the liquid ejecting head. The control section sets, as a second flow rate greater than the first flow rate, a flow rate of the liquid, which is circulated by the circulating mechanism, per unit time, during a recovery operation of recovering a state of the liquid ejecting head.

9 Claims, 11 Drawing Sheets

LIQUID EJECTING APPARATUS

The present application is based on, and claims priority from JP Application Serial Number 2021-082070, filed May 14, 2021, the disclosure of which is hereby incorporated by reference herein in its entirety.

BACKGROUND

1. Technical Field

The present disclosure relates to a liquid ejecting apparatus.

2. Related Art

A liquid ejecting apparatus typified by an ink jet printer may have a configuration for circulating a liquid in a liquid ejecting head that ejects a liquid such as ink, as disclosed in JP-A-2013-184372 and JP-A-2010-214847, for example.

The head described in JP-A-2013-184372 has a plurality of pressure generation chambers communicating with a nozzle opening, a first manifold and a second manifold communicating with the plurality of pressure generation chambers, and a bypass flow channel for coupling the manifolds through a system different from the pressure generation chambers. Here, ink is supplied from an ink cartridge to the first manifold by the driving force of the pump. The ink flows from the first manifold to the second manifold through the pressure generation chamber or the bypass flow channel, and then circulates in the path returning to the ink cartridge. In JP-A-2013-184372, when a flow channel resistance of the bypass flow channel is R, a flow channel resistance of the flow channel coupling the two manifolds including the pressure generation chamber is r, and the number of nozzle openings is N, $R<r/N$.

The head described in JP-A-2010-214847 has a plurality of pressure chambers communicating with a nozzle, a supply-side common flow channel for storing the liquid supplied to the pressure chamber through the liquid supply channel, a circulation-side common flow channel for storing the liquid which is recovered through a liquid circulation channel from the pressure chamber, and a bypass flow channel for flowing the liquid from the supply-side common flow channel to the circulation-side common flow channel. Here, when the flow channel resistance of the bypass flow channel is R, the number of pressure chambers is N, and a flow channel resistance from the liquid supply channel to the liquid circulation channel through the pressure chamber is r, $r/N<R<r$.

In the configuration for circulating the liquid as described above, an increase in viscosity of the liquid can be suppressed even when the liquid is circulated at a relatively small flow rate. However, in order to remove air bubbles in the flow channel, it is necessary to increase a flow rate of the circulating liquid. In the related art, since the flow rate of the circulating liquid is constant, trying to remove air bubbles in the flow channel causes an increase in capacity of the pump. For this reason, in the related art, there is a problem in that it is not possible to reduce the increase in viscosity of the ink or remove air bubbles while trying to reduce the cost.

SUMMARY

According to an aspect of the present disclosure, there is provided a liquid ejecting apparatus including: a liquid ejecting head that has a plurality of individual flow channels provided with nozzles, a common supply flow channel through which a liquid is supplied to the plurality of individual flow channels, a common discharge flow channel through which the liquid is discharged from the plurality of individual flow channels, and a bypass flow channel that bypasses the plurality of individual flow channels and causes the common supply flow channel and the common discharge flow channel to communicate with each other; a circulating mechanism that circulates the liquid, which is supplied from the common supply flow channel, so as to discharge the liquid from the common discharge flow channel through the plurality of individual flow channels or the bypass flow channel; and a control section that controls an operation of the circulating mechanism, in which the control section sets, as a first flow rate, a flow rate of the liquid, which is circulated by the circulating mechanism, per unit time, during an ejection operation of ejecting the liquid from the liquid ejecting head, and sets, as a second flow rate greater than the first flow rate, a flow rate of the liquid, which is circulated by the circulating mechanism, per unit time, during a recovery operation of recovering a state of the liquid ejecting head.

According to the other aspect of the present disclosure, there is provided a liquid ejecting apparatus including: a liquid ejecting head that has a plurality of individual flow channels provided with nozzles, a common supply flow channel through which a liquid is supplied to each of the plurality of individual flow channels, a common discharge flow channel through which the liquid is discharged from each of the plurality of individual flow channels, and a bypass flow channel that bypasses the plurality of individual flow channels and causes the common supply flow channel and the common discharge flow channel to communicate with each other; a circulating mechanism that circulates the liquid, which is supplied from the common supply flow channel, so as to discharge the liquid from the common discharge flow channel through the plurality of individual flow channels or the bypass flow channel; and a control section that controls an operation of the circulating mechanism, in which the control section sets, as a first flow rate, a flow rate of the liquid, which is circulated by the circulating mechanism, per unit time, during an ejection operation of ejecting the liquid from the liquid ejecting head, and sets, as a third flow rate greater than the first flow rate, a flow rate of the liquid, which is supplied to the liquid ejecting head, per unit period, during a filling operation of filling the liquid ejecting head with the liquid.

DESCRIPTION OF EXEMPLARY EMBODIMENTS

Figure 1:
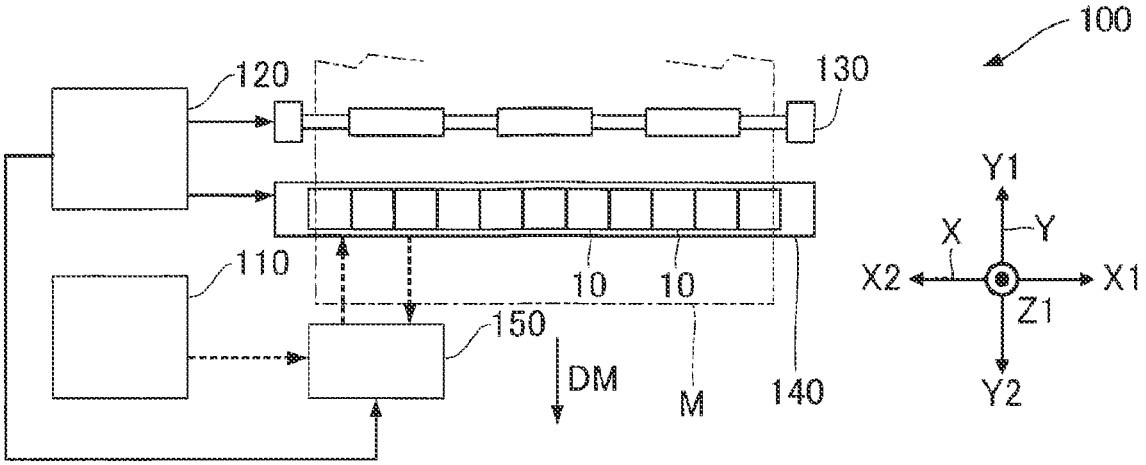
FIG. 1 is a schematic diagram illustrating a configuration example of a liquid ejecting apparatus according to an embodiment.

Hereinafter, preferred embodiments according to the present disclosure will be described with reference to accompanying drawings. In the drawings, the dimensions and scale of each part are appropriately different from the actual ones, and some parts are schematically illustrated for facilitating understanding. The scope of the present disclosure is not limited to the forms unless it is stated in the following description that the present disclosure is particularly limited.

The following description will be given appropriately using the X axis, Y axis and Z axis that intersect each other for convenience. Further, one direction along the X axis is the X1 direction, and a direction opposite to the X1 direction is the X2 direction. The X1 direction or the X2 direction is an example of a "second direction". In a similar manner, the directions opposite to each other along the Y axis are the Y1 direction and the Y2 direction. The Y1 direction or the Y2 direction is an example of a "third direction". Further, directions opposite to each other along the Z axis are the Z1 direction and the Z2 direction. The Z1 direction or the Z2 direction is an example of a "first direction".

Here, typically, the Z axis is a vertical axis, and the Z2 direction corresponds to a downward direction in the vertical direction. Here, the Z axis does not have to be a vertical axis and may be inclined with respect to the vertical axis. The X axis, the Y axis, and the Z axis are typically orthogonal to each other, but are not limited to this, and may intersect at an angle within a range of, for example, 80° or more and 100° or less. The "second direction" may be any direction orthogonal to the Z axis, and may be, for example, the Y1 direction or the Y2 direction. The "third direction" may be orthogonal to both the "first direction" and the "second direction", and may be, for example, the X1 direction or the X2 direction when the "second direction" is the Y1 direction or the Y2 direction.

1. Embodiment

1-1. Liquid Ejecting Apparatus 100

FIG. 1 is a schematic diagram illustrating a configuration example of a liquid ejecting apparatus 100 according to an embodiment. The liquid ejecting apparatus 100 is an ink jet printing apparatus that ejects ink, which is an example of a liquid, as droplets onto a medium M. The liquid ejecting apparatus 100 of the present embodiment is a so-called line-type printing apparatus in which a plurality of nozzles for ejecting ink are distributed throughout the entire range in the width direction of the medium M. The medium M is typically a printing paper. The medium M is not limited to the printing paper, and may be a printing target of any material such as a resin film or cloth.

As illustrated in FIG. 1, the liquid ejecting apparatus 100 has a liquid container 110, a control unit 120 which is an example of a "control section", a transport mechanism 130, a liquid ejecting module 140, and a circulating mechanism 150.

The liquid container 110 is a container for storing an ink. Specific embodiments of the liquid container 110 include, for example, a cartridge that is attachable to and detachable from the liquid ejecting apparatus 100, a bag-shaped ink package made of a flexible film, and an ink tank that can be refilled with the ink. The type of the ink stored in the liquid container 110 is optional.

Although not illustrated in the drawing, the liquid container 110 of the present embodiment includes a first liquid container and a second liquid container. The first liquid container stores a first ink. The second liquid container stores a second ink having a type different from that of the first ink. For example, the first ink and the second ink are inks with different colors from each other. The first ink and the second ink may be the same type of ink.

The control unit 120 controls an operation of each element of the liquid ejecting apparatus 100. The control unit 120 includes, for example, one or a plurality of processing circuits such as a central processing unit (CPU) or a field programmable gate array (FPGA) and one or a plurality of storage circuits such as a semiconductor memory. The storage circuit stores various programs and various data. The processing circuit realizes various controls by executing the programs and using the data as appropriate.

The transport mechanism 130 transports a medium M in a direction DM under control of the control unit 120. The direction DM of the present embodiment is the Y2 direction. In an example illustrated in FIG. 1, the transport mechanism 130 includes a long transport roller along the X axis and a motor that rotates the transport roller. The transport mechanism 130 is not limited to the configuration using the transport roller, and may be configured to use, for example, a drum or an endless belt that transports the medium M in a state where the medium M is attracted to the outer peripheral surface by electrostatic force or the like.

Under the control of the control unit 120, the liquid ejecting module 140 ejects the ink, which is supplied from the liquid container 110 through the circulating mechanism 150, from each of the plurality of nozzles to the medium M in the Z2 direction. The liquid ejecting module 140 is a line head having a plurality of liquid ejecting heads 10 disposed such that a plurality of nozzles are distributed throughout the entire range of the medium M in the direction of the X axis. That is, the group of the plurality of liquid ejecting heads 10 constitutes a long line head extending in the direction along the X axis. An image of ink is formed on the surface of the medium M by ejecting the ink from the plurality of liquid ejecting heads 10 in parallel with the transport of the medium M by the transport mechanism 130. It should be noted that the plurality of nozzles of one liquid ejecting head 10 may be disposed so as to be distributed throughout the entire range of the medium M in the direction along the X axis. In such a case, for example, the liquid ejecting module 140 may be constituted of one liquid ejecting head 10.

A liquid container 110 is coupled to the liquid ejecting module 140 through the circulating mechanism 150. The circulating mechanism 150 supplies the ink to the liquid ejecting module 140 under the control of the control unit 120, and recovers the ink discharged from the liquid ejecting module 140 in order to resupply the ink to the liquid ejecting module 140. The circulating mechanism 150 has, for example, a sub tank that stores the ink, a supply flow channel for supplying the ink from the sub tank to the liquid ejecting module 140, a recovery flow channel for recovering the ink from the liquid ejecting module to the sub tank, and a pump for appropriately flowing the ink. The sub tank, the supply flow channel, the recovery flow channel, and the pump are provided for each container of the above-mentioned first liquid container and second liquid container. By the operation of the circulating mechanism 150 as described above, it is possible to suppress an increase in viscosity of the ink and reduce the retention of air bubbles in the ink.

1-2. Liquid Ejecting Module 140

Figure 2:
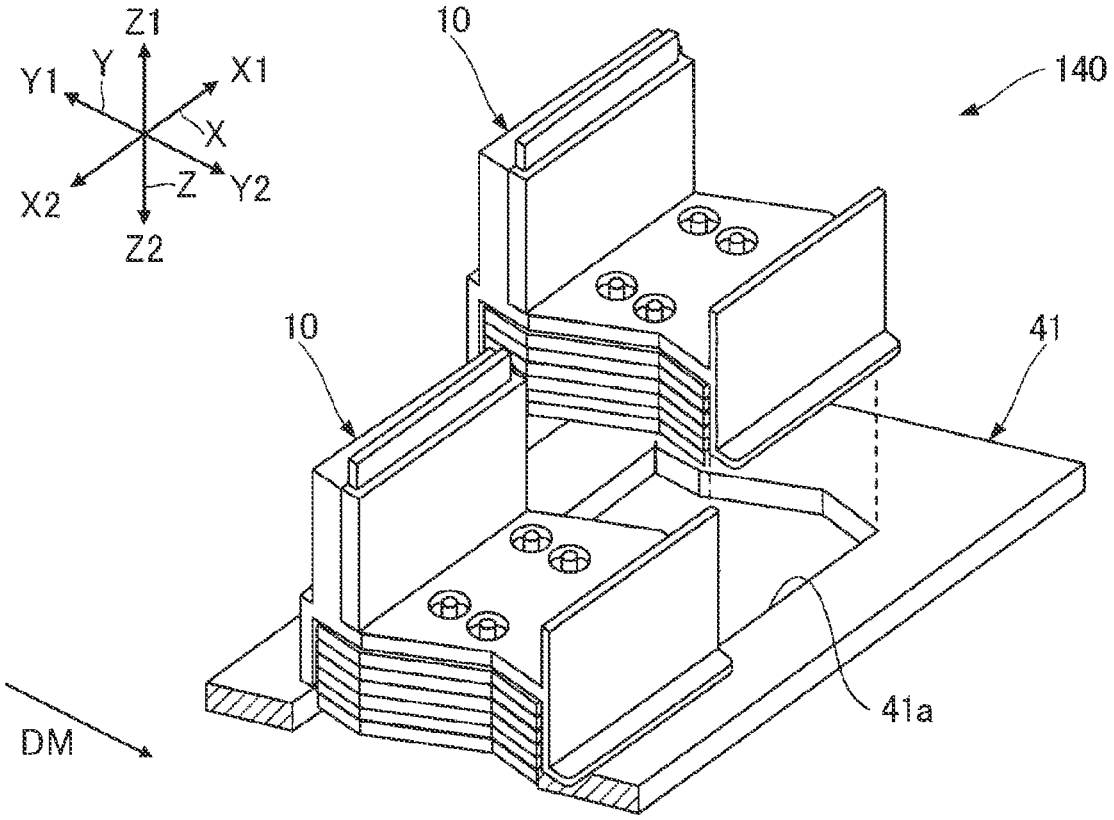
FIG. 2 is a perspective view of a liquid ejecting module having liquid ejecting heads according to the embodiment.

FIG. 2 is a perspective view of the liquid ejecting module 140 having the liquid ejecting heads 10 according to the embodiment. As illustrated in FIG. 2, the liquid ejecting module 140 has a support 41 and the plurality of liquid ejecting heads 10. The support 41 is a member which supports the plurality of liquid ejecting heads 10. In an example illustrated in FIG. 2, the support 41 is a plate-shaped member made of metal or the like, and is provided with mount holes 41*a* for mounting the plurality of liquid ejecting heads 10. The plurality of liquid ejecting heads 10 are inserted into the mount holes 41*a* in a state of being lined up in a direction along the X axis. Each liquid ejecting head 10 is fixed to the support 41 by screwing or the like. FIG. 2 illustrates typically two liquid ejecting heads 10. The number of liquid ejecting heads 10 in the liquid ejecting module 140 is optional. The shape of the support 41 and the like are not limited to the example illustrated in FIG. 2, and are optional.

1-3. Liquid Ejecting Head 10

Figure 3:
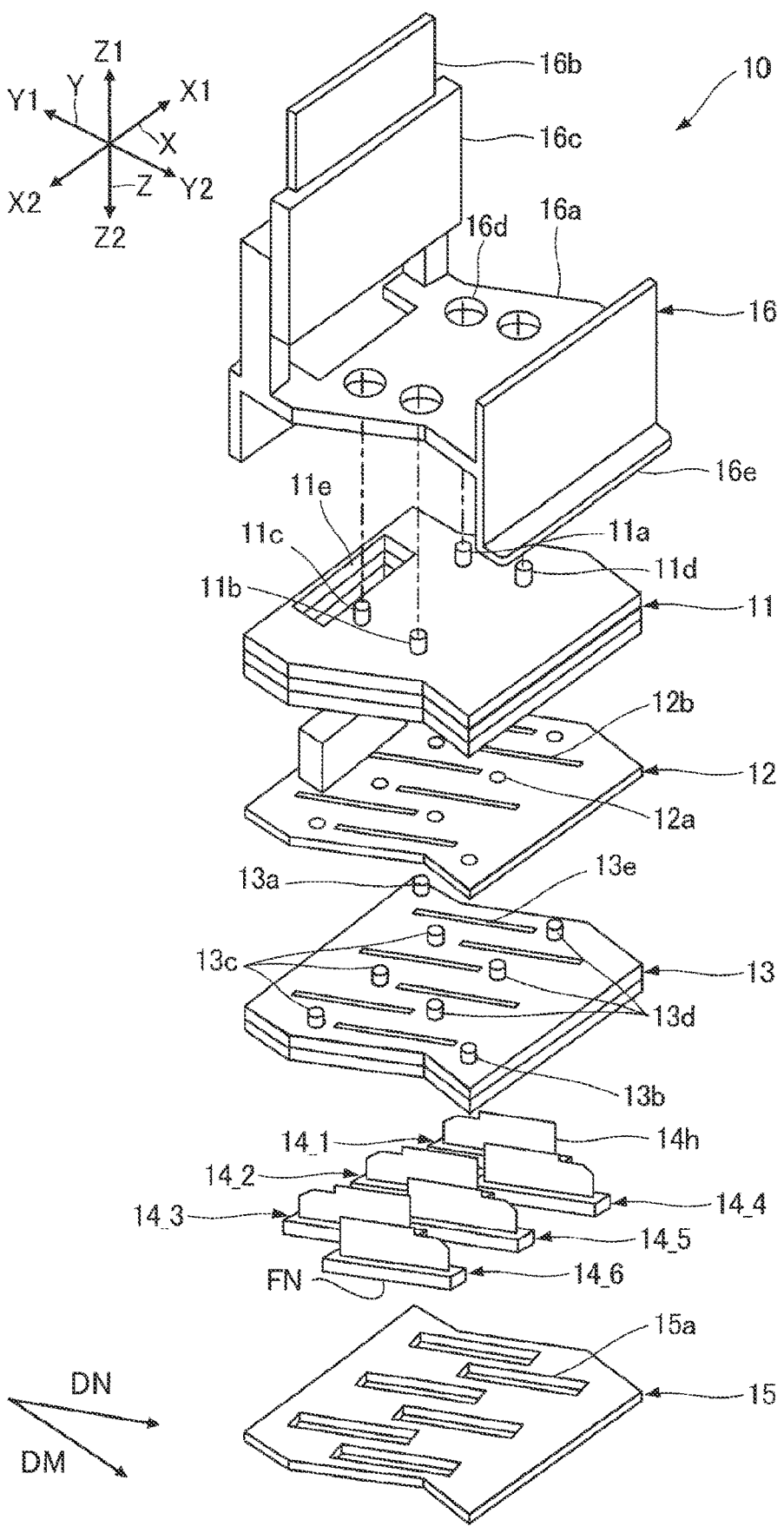
FIG. 3 is an exploded perspective view of the liquid ejecting head illustrated in FIG. 2.

FIG. 3 is an exploded perspective view of the liquid ejecting head 10 illustrated in FIG. 2. As illustrated in FIG. 3, the liquid ejecting head 10 has a flow channel structure 11, a wiring substrate 12, a holder 13, a plurality of head main bodies 141, 14_2, 14_3, 14_4, 145, and 14_6, a fixing plate 15, and a base 16. The base 16, the flow channel structure 11, the wiring substrate 12, the holder 13, the plurality of head main bodies 14_1, 14_2, 14_3, 14_4, 14_5, and 14_6, and the fixing plate 15 are disposed in this order of in the Z2 direction. Hereinafter, each section of the liquid ejecting head 10 will be described in sequence. In the following, each of the head main bodies 14_1, 14_2, 14_3, 14_4, 14_5, and 14_6 may be referred to as a head main body 14.

The flow channel structure 11 is a structure in which a flow channel for flowing the ink between the circulating mechanism 150 and the plurality of head main bodies 14 are provided inside. As illustrated in FIG. 3, the flow channel structure 11 is provided with a coupling tube 11*a*, a coupling tube 11*b*, a coupling tube 11*c*, a coupling tube 11*d*, and a hole lie.

Here, although not illustrated in FIG. 3, inside the flow channel structure 11, there are provided flow channels such as a first supply flow channel, a second supply flow channel, a first discharge flow channel, and a second discharge flow channel. The first supply flow channel is a flow channel through which the first ink is supplied to the plurality of head main bodies 14. The second supply flow channel is a flow channel through which the second ink is supplied to the plurality of head main bodies 14. A filter for capturing foreign matter and the like is provided in the middle of each of the supply flow channels. The first discharge flow channel is a flow channel through which the first ink is discharged from the plurality of head main bodies 14. The second discharge flow channel is a flow channel through which the second ink is discharged from the plurality of head main bodies 14. The flow channel of the flow channel structure 11 will be described with reference to FIGS. 9 and 10 to be described later.

The coupling tubes 11*a*, 11*b*, 11*c*, and 11*d* are tube bodies protruding in the Z1 direction. More specifically, the coupling tube 11*a* is a tube body constituting a flow channel through which the first ink is supplied to the first supply flow channel. The coupling tube lib is a tube body constituting a flow channel through which the second ink is supplied to the second supply flow channel. On the other hand, the coupling tube 11*c* is a tube body constituting a flow channel through which the first ink is discharged from the first discharge flow channel. The coupling tube 11*d* is a tube body constituting a flow channel through which the second ink is discharged from the second discharge flow channel. The hole lie is a hole into which the connector 12*c* to be described later is inserted. The coupling tubes 11*a*, 11*b*, 11*c*, and 11*d* are coupled to tubes that are coupled to the outside. The liquid is supplied into the liquid ejecting head 10 from the outside through the coupling tubes 11*a* and 11*b*. The liquid is discharged from the inside of the liquid ejecting head 10 to the outside through the coupling tubes 11*c* and 11*d*.

The wiring substrate 12 is a mount component that electrically couples a plurality of head main bodies 14 and an assembly substrate 16*b* to be described later. The wiring substrate 12 is, for example, a rigid wiring substrate. The wiring substrate 12 is disposed between the flow channel structure 11 and the holder 13. The connector 12*c* is provided on the surface of the wiring substrate 12 facing the flow channel structure 11. The connector 12*c* is a coupling component coupled to the assembly substrate 16*b* to be described later. The wiring substrate 12 is provided with a plurality of holes 12*a* and a plurality of opening portions 12*b*. Each hole 12*a* is a hole for causing coupling between the flow channel structure 11 and the holder 13. Each opening portion 12*b* is a hole through which the wiring substrate 14*h* coupling the head main body 14 and the wiring substrate 12 is passed. The wiring substrate 14*h* is coupled to the surface of the wiring substrate 12 facing the Z1 direction. The wiring substrate 14*h* is a member including wiring electrically coupled to the piezoelectric element 14*e* to be described later, and is, for example, flexible printed circuits (FPC), chip on film (COF), or the like.

The holder 13 is a structure that accommodates and supports the plurality of head main bodies 14. The holder 13 is made of, for example, a resin material, a metal material, or the like. The holder 13 has a plate shape which extends in a direction perpendicular to the Z axis. The holder 13 is provided with a coupling tube 13*a*, a coupling tube 13*b*, a plurality of coupling tubes 13*c*, a plurality of coupling tubes 13*d*, and a plurality of wiring holes 13*e*. Although not illustrated, a plurality of recess portions for accommodating a plurality of head main bodies 14 are provided on the surface of the holder 13 facing the Z2 direction.

In the present embodiment, the holder 13 holds six head main bodies 14_1 to 14_6. The head main bodies are arranged in the X2 direction in the order of head main bodies 14_1, 14_4, 14_2, 14_5, 14_3, and 14_6. Here, the head main bodies 14_1 to 14_3 are disposed at positions shifted in the Y1 direction with respect to the head main bodies 14_4 to 14_6. However, the head main bodies 14_1 to 14_6 have portions that overlap each other as viewed in the X1 direction or the X2 direction. The arrangement direction DN of a plurality of nozzles N to be described later in the head main bodies 14_1 to 14_6 are parallel to each other. Each of the head main bodies 14_1 to 14_6 is disposed such that the arrangement direction DN is inclined with respect to the direction DM which is the transport direction of the medium M.

Here, although not illustrated in FIG. 3, inside the holder 13, there are provided a first distribution supply flow channel, a second distribution supply flow channel, a plurality of first individual discharge flow channels, a plurality of second individual discharge flow channels, and a plurality of bypass flow channels. The first distribution supply flow channel is a flow channel having a branch through which the first ink is supplied to the plurality of head main bodies 14. The second distribution supply flow channel is a flow channel having a branch through which the second ink is supplied to the plurality of head main bodies 14. The first individual discharge flow channel is provided for each head main body 14 that discharges the first ink, and is a flow channel through which the first ink discharged from the head main body 14 is introduced into the first discharge flow channel of the flow channel structure 11. The second individual discharge flow channel is provided for each head main body 14 that discharges the second ink, and is a flow channel through which the second ink discharged from the head main body 14 is introduced into the second discharge flow channel of the flow channel structure 11. The two bypass flow channels are provided for each head main body 14, and are bypass flow channels for communicating the first common liquid chamber R1 and the second common liquid chamber R2 to be described later. The flow channel of the holder 13 will be described with reference to FIGS. 6 to 8 to be described later.

In the present embodiment, among the head main bodies 14_1 to 14_6, the first ink is supplied to the head main bodies 14_1 to 14_3, and the second ink is supplied to the head main bodies 14_4 to 14_6.

The coupling tubes 13*a*, 13*b*, 13*c*, and 13*d* are tubular protrusions protruding in the Z1 direction. More specifically, the coupling tube 13*a* is a tube body constituting a flow channel through which the first ink is supplied to the first distribution supply flow channel, and communicates with the first supply flow channel of the flow channel structure 11. The coupling tube 13*b* is a tube body constituting a flow channel through which the second ink is supplied to the second distribution supply flow channel, and communicates with the second supply flow channel of the flow channel structure 11. On the other hand, the coupling tube 13*c* is a tube body constituting a flow channel through which the first ink is discharged from the first individual discharge flow channel, and communicates with the first discharge flow channel of the flow channel structure 11. The coupling tube 13*d* is a tube body constituting a flow channel through which the second ink is discharged from the second individual discharge flow channel, and communicates with the second discharge flow channel of the flow channel structure 11. The wiring hole 13*e* is a hole through which the wiring substrate 14*h* coupling the head main body 14 and the wiring substrate 12 is passed.

Each head main body 14 ejects an ink. Specifically, although not illustrated in FIG. 3, each head main body 14 has a plurality of nozzles for ejecting the first ink and a plurality of nozzles for ejecting the second ink. The nozzles are provided on the nozzle surface FN, which is the surface of each head main body 14 facing the Z2 direction. Details of the head main body 14 will be described with reference to FIG. 4 to be described later.

The fixing plate 15 is a plate member which fixes a plurality of head main bodies 14 to the holder 13. Specifically, the fixing plate 15 is disposed with a plurality of head main bodies 14 pinched between the fixing plate 15 and the holder 13, and is fixed to the holder 13 with an adhesive. The fixing plate 15 is made of, for example, a metal material. The fixing plate 15 is provided with a plurality of opening portions 15*a* for exposing the nozzles of the plurality of head main bodies 14. In an example illustrated in FIG. 3, the plurality of opening portions 15*a* are individually provided for each head main body 14. Two or more head main bodies 14 may share the opening portions 15*a*.

The base 16 is a member which fixes the flow channel structure 11, the wiring substrate 12, the holder 13, the plurality of head main bodies 14, and the fixing plate 15 to the above-mentioned support 41. The base 16 has a main body 16*a*, an assembly substrate 16*b*, and a cover 16*c*.

The main body 16*a* holds the flow channel structure 11 and the wiring substrate 12 disposed between the base 16 and the holder 13 by being fixed to the holder 13 through screwing or the like. The main body 16*a* is made of, for example, a resin material or the like. The main body 16*a* has a plate-shaped portion facing the plate-shaped portion of the flow channel structure 11 described above, and the plate-shaped portion is provided with a plurality of holes 16*d* into which the coupling tubes 11*a*, 11*b*, 11*c*, and 11*d* described above are inserted. The main body 16*a* has a portion extending in the Z2 direction from the plate-shaped portion, and the tip of the portion is provided with a flange 16*e* for fixing to the above-mentioned support 41.

The assembly substrate 16*b* is a mount component that electrically couples the control unit 120 and the wiring substrate 12 described above. The assembly substrate 16*b* is, for example, a rigid wiring substrate. The cover 16*c* is a plate-shaped member which protects the assembly substrate 16*b* and fixes the assembly substrate 16*b* to the main body 16*a*. The cover 16*c* is made of, for example, a resin material or the like, and is fixed to the main body 16*a* through screwing or the like.

1-4. Head Main Body 14

Figure 4:
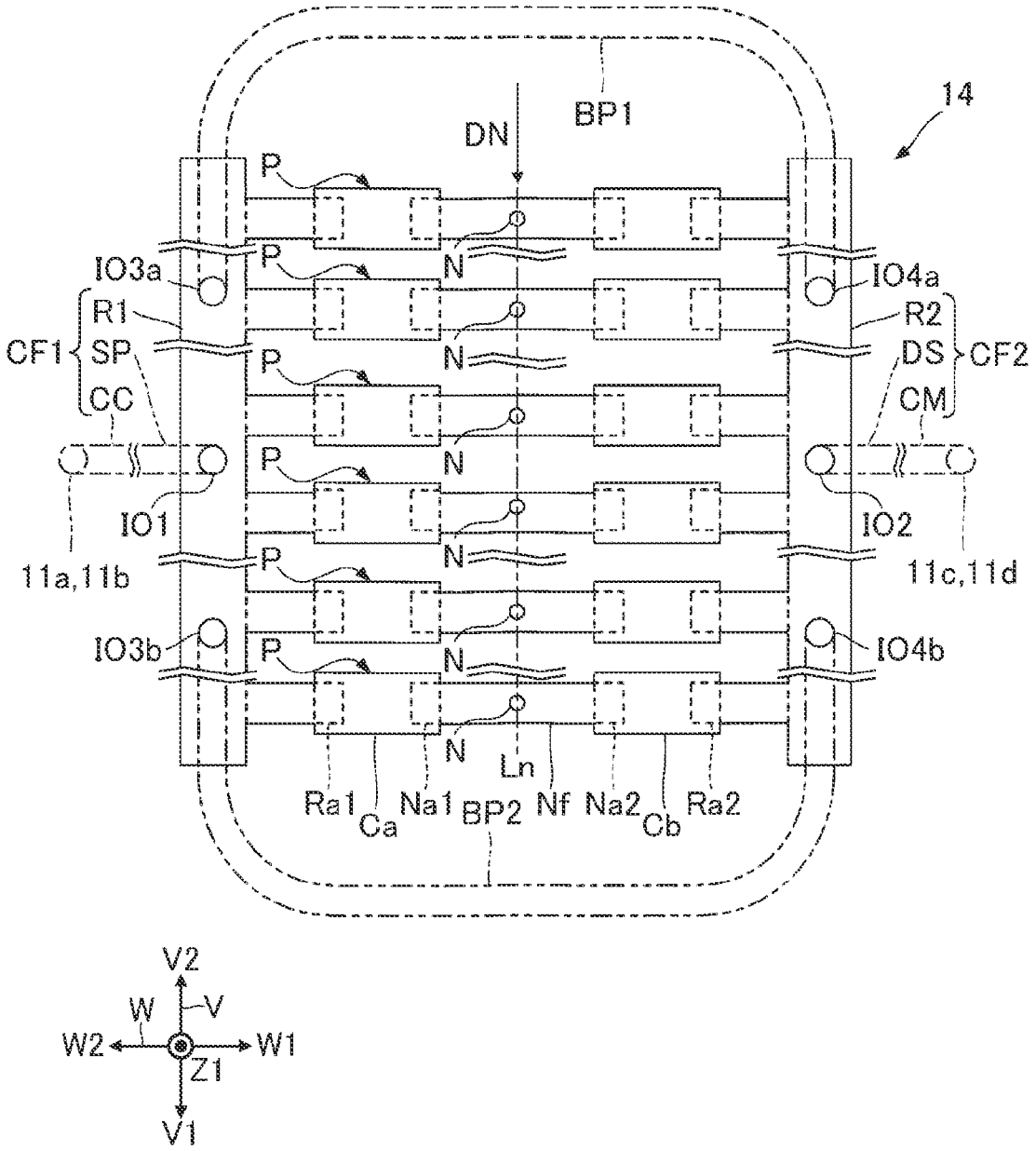
FIG. 4 is a plan view schematically illustrating a flow channel of a head main body included in the liquid ejecting head.

FIG. 4 is a plan view schematically illustrating a flow channel of the head main body 14 included in the liquid ejecting head 10. The following description will be given appropriately using a V axis and a W axis in addition to the X axis, the Y axis, and the Z axis for convenience. One direction along the V axis is a V1 direction, and the direction opposite to the V1 direction is a V2 direction. In a similar manner, the directions opposite to each other along the W axis are the W1 direction and the W2 direction.

Here, the V axis is an axis along the arrangement direction of the plurality of nozzles N to be described later, and is an axis which is obtained by rotating the Y axis around the Z axis at a predetermined angle. The W axis is an axis which is obtained by rotating the X axis around the Z axis at the predetermined angle. Therefore, the V axis and the W axis are typically orthogonal to each other, but are not limited to this, and may intersect at an angle within a range of, for example, 80° or more and 100° or less. The predetermined angle, that is, the angle which is formed by the V axis and the Y axis, or the angle which is formed by the W axis and the X axis is, for example, within the range of 40° or more and 60° or less.

As illustrated in FIG. 4, the head main body 14 is provided with the plurality of nozzles N, a plurality of individual flow channels P, a first common liquid chamber R1, and a second common liquid chamber R2. Here, the first common liquid chamber R1 and the second common liquid chamber R2 communicate with each other through the plurality of individual flow channels P. Further, as indicated by the chain double-dashed line in FIG. 4, the bypass flow channels BP1 and BP2 are coupled to the first common liquid chamber R1 and the second common liquid chamber R2. The bypass flow channels BP1 and BP2 are flow channels that bypass the plurality of individual flow channels P and cause the first common liquid chamber R1 and the second common liquid chamber R2 to communicate with each other, and are provided in the holder 13. Details of the bypass flow channels BP1 and BP2 will be described with reference to FIGS. 6, 7 and 8 to be described later.

The head main body 14 has a surface facing the medium M. As illustrated in FIG. 4, the plurality of nozzles N are provided on the surface. The plurality of nozzles N are arranged along the V axis. Each of the plurality of nozzles N ejects the ink in the Z2 direction.

Here, a set of the plurality of nozzles N constitutes a nozzle line Ln. The plurality of nozzles N are arranged at equal intervals at a predetermined pitch. The predetermined pitch is a distance between the centers of the plurality of nozzles N in the direction along the V axis.

The individual flow channel P communicates with each of the plurality of nozzles N. Each of the plurality of individual flow channels P extends along the W axis and communicates with the nozzles N different from each other. The plurality of individual flow channels P are arranged along the V axis.

As illustrated in FIG. 4, each individual flow channel P has a pressure chamber Ca, a pressure chamber Cb, a nozzle flow channel Nf, an individual supply flow channel Ra1, an individual discharge flow channel Ra2, a first communication flow channel Na1, and a second communication flow channel Na2.

Each of the pressure chamber Ca and the pressure chamber Cb in each individual flow channel P extends along the W axis and is a space in which the ink ejected from the nozzle N communicating with the individual flow channel P is stored. In an example illustrated in FIG. 4, the plurality of pressure chambers Ca are arranged along the V axis. In a similar manner, the plurality of pressure chambers Cb are arranged along the V axis. In each individual flow channel P, positions of the pressure chamber Ca and the pressure chamber Cb in the direction along the V axis are the same in the example illustrated in FIG. 4, but may be different from each other. In the following, when the pressure chamber Ca and the pressure chamber Cb are not particularly distinguished, each pressure chamber may be referred to as "pressure chamber C".

The nozzle flow channel Nf is disposed between the pressure chamber Ca and the pressure chamber Cb in each individual flow channel P. Here, the pressure chamber Ca communicates with the nozzle flow channel Nf through the first communication flow channel Na1 which extends along the Z axis. The pressure chamber Cb communicates with the nozzle flow channel Nf through the second communication flow channel Na2 which extends along the Z axis.

In each individual flow channel P, the nozzle flow channel Nf is a space which extends along the W axis. The plurality of nozzle flow channels Nf are arranged along the V axis at intervals from each other. The nozzle N is provided in each nozzle flow channel Nf. In each nozzle flow channel Nf, the ink is ejected from the nozzle N by changing the pressure in the pressure chamber Ca and the pressure chamber Cb described above.

Each of the first communication flow channel Na1 and the second communication flow channel Na2 is a space which extends along the Z axis. The first communication flow channel Na1 and the second communication flow channel Na2 may be provided as necessary, and may be removed.

The first common liquid chamber R1 and the second common liquid chamber R2 communicate with the plurality of individual flow channels P. Here, the pressure chamber Ca communicates with the first common liquid chamber R1 through the individual supply flow channel Ra1 which extends along the Z axis. The pressure chamber Cb communicates with the second common liquid chamber R2 through the individual discharge flow channel Ra2 which extends along the Z axis.

Each of the first common liquid chamber R1 and the second common liquid chamber R2 is a space which extends along the V axis throughout the entire range in which the plurality of nozzles N are distributed. Here, the first common liquid chamber R1 is coupled to the end of each individual flow channel P in the W2 direction. The first common liquid chamber R1 stores the ink for supplying to each individual flow channel P. On the other hand, the second common liquid chamber R2 is coupled to the end of each individual flow channel P in the W1 direction. The second common liquid chamber R2 stores the ink discharged from each individual flow channel P without being ejected.

The first common liquid chamber R1 is provided with a supply port IO1, a discharge port IO3*a*, and a discharge port IO3*b*. The supply port IO1 is a tube path through which the ink is introduced from the distribution supply flow channel SP of the holder 13 into the first common liquid chamber R1. The discharge port IO3*a* is a tube path through which the ink is discharged from the first common liquid chamber R1 to the bypass flow channel BP1. The discharge port IO3*b* is a tube path through which the ink is discharged from the first common liquid chamber R1 to the bypass flow channel BP2. The distribution supply flow channel SP is a first distribution supply flow channel SP1 or a second distribution supply flow channel SP2 to be described later.

Here, the distribution supply flow channel SP is coupled to the circulating mechanism 150 through the supply flow channel CC of the flow channel structure 11. Therefore, a flow channel extending from the coupling tube 11*a* or the coupling tube lib to the first common liquid chamber R1 is commonly provided for the plurality of pressure chambers C, and constitutes a common supply flow channel CF1 through which the ink is supplied to the plurality of individual flow channels P. The supply flow channel CC is a first supply flow channel CC1 or a second supply flow channel CC2 to be described later. Although not illustrated in FIG. 4, the common supply flow channel CF1 includes not only the first common liquid chamber R1, the distribution supply flow channel SP, and the supply flow channel CC, but also a first filter chamber RF1 or a second filter chamber RF2 to be described later. More specifically, the common supply flow channel CF1 represents a flow channel of the members constituting the liquid ejecting head 10 which ranges immediately before the individual flow channel P immediately after a portion (coupling tube 11*a*, coupling tube 11*b*) to which a tube for supplying liquid from the outside of the liquid ejecting head 10 is coupled. That is, the common supply flow channel CF1 is a flow channel from the first filter chamber RF1 and the second filter chamber RF2 to the first common liquid chamber R1.

The second common liquid chamber R2 is provided with a discharge port IO2, an introduction port IO4*a*, and an introduction port IO4*b*. The discharge port IO2 is a tube path through which the ink is discharged from the second common liquid chamber R2 to an individual discharge flow channel DS of the holder 13. The introduction port IO4*a* is a tube path through which the ink is introduced from the bypass flow channel BP1 to the second common liquid chamber R2. The introduction port IO4*b* is a tube path through which the ink is introduced from the bypass flow channel BP2 into the second common liquid chamber R2. The individual discharge flow channel DS is the first individual discharge flow channel DS1 or the second individual discharge flow channel DS2 to be described later.

Here, the individual discharge flow channel DS is coupled to the circulating mechanism 150 through a discharge flow channel CM of the flow channel structure 11. Therefore, a flow channel extending from the second common liquid chamber R2 to the coupling tube 11*a* or the coupling tube 11*b* is commonly provided for the plurality of pressure chambers C, and constitutes a common discharge flow channel CF2 through which the ink is discharged from the plurality of individual flow channels P. The discharge flow channel CM is the first discharge flow channel CM1 or the second discharge flow channel CM2 to be described later. The common discharge flow channel CF2 indicates a path of the members constituting the liquid ejecting head 10 which ranges immediately after the individual flow channel P immediately before a portion (coupling tube 11*c*, coupling tube d) to which a tube for discharging the liquid is coupled to the outside of the liquid ejecting head 10.

Figure 5:
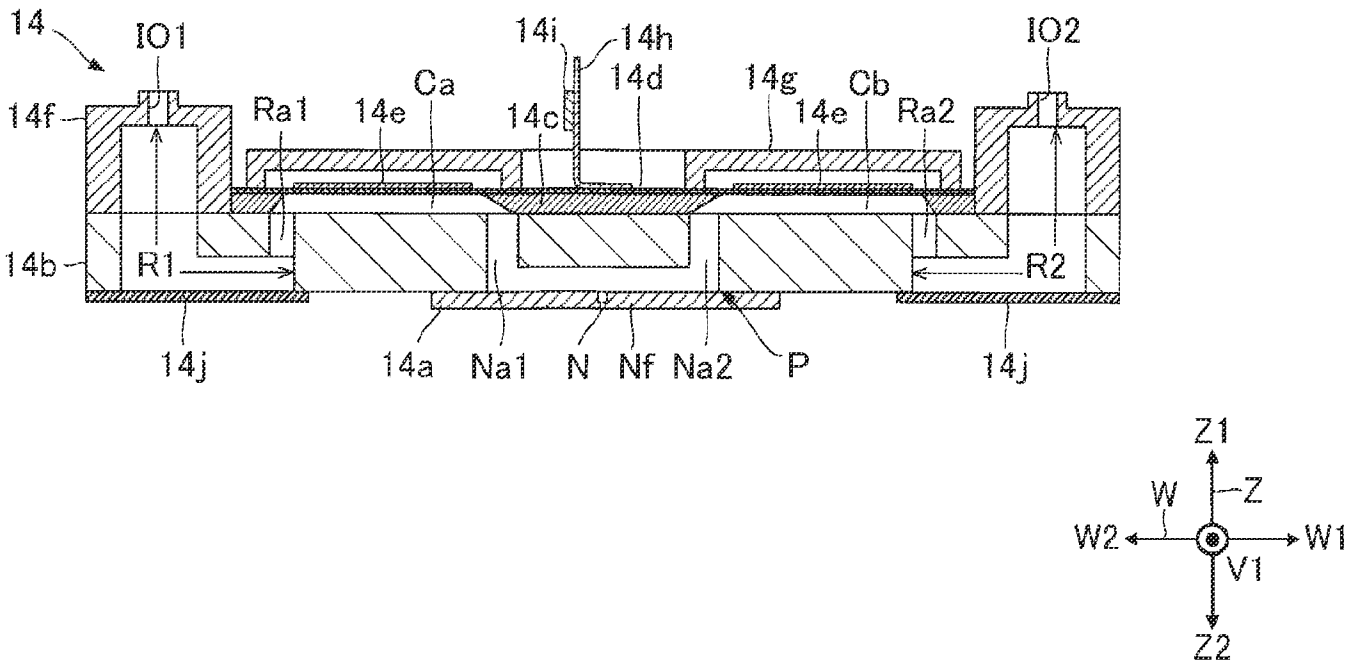
FIG. 5 is a cross-sectional view of the head main body included in the liquid ejecting head.

FIG. 5 is a cross-sectional view of the head main body 14 included in the liquid ejecting head 10. FIG. 5 illustrates a cross section of the head main body 14 which is cut in a plane including the W axis and the Z axis. As illustrated in FIG. 5, the head main body 14 has a nozzle substrate 14*a*, a flow channel substrate 14*b*, a pressure chamber substrate 14*c*, a vibration plate 14*d*, a plurality of piezoelectric elements 14*e*, a case 14*f*, a protective plate 14g, and a wiring substrate 14*h*.

The nozzle substrate 14*a*, the flow channel substrate 14*b*, the pressure chamber substrate 14*c*, and the vibration plate 14*d* are laminated in this order in the Z1 direction. Each of The members extends along the V axis and is manufactured, for example, by processing a silicon single crystal substrate using a semiconductor processing technique. The members are bonded to each other by an adhesive or the like. It should be noted that another layer such as an adhesive layer or a substrate may be appropriately interposed between two adjacent members among the members.

The plurality of nozzles N are provided on the nozzle substrate 14*a*. Each of the plurality of nozzles N penetrates the nozzle substrate 14*a* and is a through hole through which the ink passes. The plurality of nozzles N are arranged in the direction along the V axis.

The flow channel substrate 14*b* is provided with a portion of each of the first common liquid chamber R1 and the second common liquid chamber R2 and a portion of the plurality of individual flow channels P excluding the pressure chamber Ca and the pressure chamber Cb. That is, the flow channel substrate 14*b* is provided with the nozzle flow channel Nf, the first communication flow channel Na1, the second communication flow channel Na2, the individual supply flow channel Ra1, and the individual discharge flow channel Ra2.

A portion of each of the first common liquid chamber R1 and the second common liquid chamber R2 is a space for penetrating the flow channel substrate 14*b*. A vibration absorbing body 14*j* that closes the opening by the space is provided on the surface of the flow channel substrate 14*b* facing the Z2 direction.

The vibration absorbing body 14*j* is a layered member made of an elastic material. The vibration absorbing body 14*j* constitutes a portion of the wall surface of each of the first common liquid chamber R1 and the second common liquid chamber R2, and absorbs the pressure fluctuation in the first common liquid chamber R1 and the second common liquid chamber R2.

The nozzle flow channel Nf is a space in a groove provided on a surface of the flow channel substrate 14*b* facing the Z2 direction. Here, the nozzle substrate 14*a* constitutes a portion of the wall surface of the nozzle flow channel Nf.

Each of the first communication flow channel Na1 and the second communication flow channel Na2 is a space for penetrating the flow channel substrate 14*b*.

Each of the individual supply flow channel Ra1 and the individual discharge flow channel Ra2 is a space for penetrating the flow channel substrate 14*b*. The individual supply flow channel Ra1 communicates the first common liquid chamber R1 and the pressure chamber Ca so as to supply the ink from the first common liquid chamber R1 to the pressure chamber Ca. Here, one end of the individual supply flow channel Ra1 is opened on a surface of the flow channel substrate 14*b* facing the Z1 direction. On the other hand, the other end of the individual supply flow channel Ra1 is an upstream end of the individual flow channel P and opens to a wall surface of the first common liquid chamber R1 in the flow channel substrate 14*b*. On the other hand, the individual discharge flow channel Ra2 communicates the second common liquid chamber R2 and the pressure chamber Cb so as to discharge the ink from the pressure chamber Cb to the second common liquid chamber R2. Here, one end of the individual discharge flow channel Ra2 is opened on the surface of the flow channel substrate 14*b* facing the Z1 direction. On the other hand, the other end of the individual discharge flow channel Ra2 is the end on the downstream of the individual flow channel P, and opens to a wall surface of the second common liquid chamber R2 in the flow channel substrate 14*b*.

The pressure chamber substrate 14*c* is provided with the pressure chambers Ca and the pressure chambers Cb of the plurality of individual flow channels P. Each of the pressure chamber Ca and the pressure chamber Cb penetrates the pressure chamber substrate 14*c* and is a gap between the flow channel substrate 14*b* and the vibration plate 14*d*.

The vibration plate 14*d* is a plate-shaped member which is able to elastically vibrate. The vibration plate 14*d* is a laminate including, for example, a first layer made of silicon oxide ($SiO_2$) and a second layer made of zirconium oxide ($ZrO_2$). Here, another layer such as a metal oxide may be interposed between the first layer and the second layer. A portion or all of the vibration plate 14*d* may be integrally made of the same material as the pressure chamber substrate 14*c*. For example, the vibration plate 14*d* and the pressure chamber substrate 14*c* can be integrally formed by selectively removing a portion in the thickness direction of the region corresponding to the pressure chamber C in the plate-shaped member having a predetermined thickness. The vibration plate 14*d* may be constituted of a layer of a single material.

The plurality of piezoelectric elements 14*e* corresponding to the pressure chambers C different from each other are provided on a surface of the vibration plate 14*d* facing the Z1 direction. Each piezoelectric element 14*e* is constituted of, for example, a laminate of a first electrode and a second electrode facing each other and a piezoelectric layer disposed between the two electrodes. Each piezoelectric element 14*e* ejects the ink in the pressure chamber C from the nozzle N by varying the pressure of the ink in the pressure chamber C. The piezoelectric element 14*e* vibrates the vibration plate 14*d* due to deformation thereof when the driving signal Com is supplied. With the vibration, the pressure chamber C expands and contracts. Therefore, the pressure of the ink in the pressure chamber C fluctuates.

The case 14*f* is a case that stores the ink. The case 14*f* is provided with a space constituting a remaining portion other than a portion provided on the flow channel substrate 14*b* for each of the first common liquid chamber R1 and the second common liquid chamber R2.

The protective plate 14*g* is a plate-shaped member provided on the surface of the vibration plate 14*d* facing the Z1 direction, protects the plurality of piezoelectric elements 14*e*, and reinforces the mechanical strength of the vibration plate 14*d*. Here, a space for accommodating the plurality of piezoelectric elements 14*e* is formed between the protective plate 14*g* and the vibration plate 14*d*.

The wiring substrate 14*h* is mounted on the surface of the vibration plate 14*d* facing the Z1 direction, and is a mount component that electrically couples the control unit 120 and the head main body 14. For example, it is preferable that a flexible wiring substrate 14*h* such as a flexible printed circuit (FPC) or a flexible flat cable (FFC) is used. The drive circuit 14*i* described above is mounted on the wiring substrate 14*h*.

In the head main body 14 having the above-mentioned configuration, the ink is distributed to the first common liquid chamber R1, the individual supply flow channel Ra1, the pressure chamber Ca, the nozzle flow channel Nf, the pressure chamber Cb, and the individual discharge flow channel Ra2 and the second common liquid chamber R2, in this order, by the operation of the circulating mechanism 150 described above.

The pressure of the pressure chamber Ca and the pressure chamber Cb is changed by simultaneously driving the piezoelectric element 14*e* corresponding to both the pressure chamber Ca and the pressure chamber Cb by the driving signal Com from the drive circuit 14*i*. Thereby, the ink is ejected from the nozzle N in accordance with the pressure fluctuation thereof. The operation of the circulating mechanism 150 will be described with reference to FIG. 12 to be described later.

1-5. Holder 13

Figure 6:
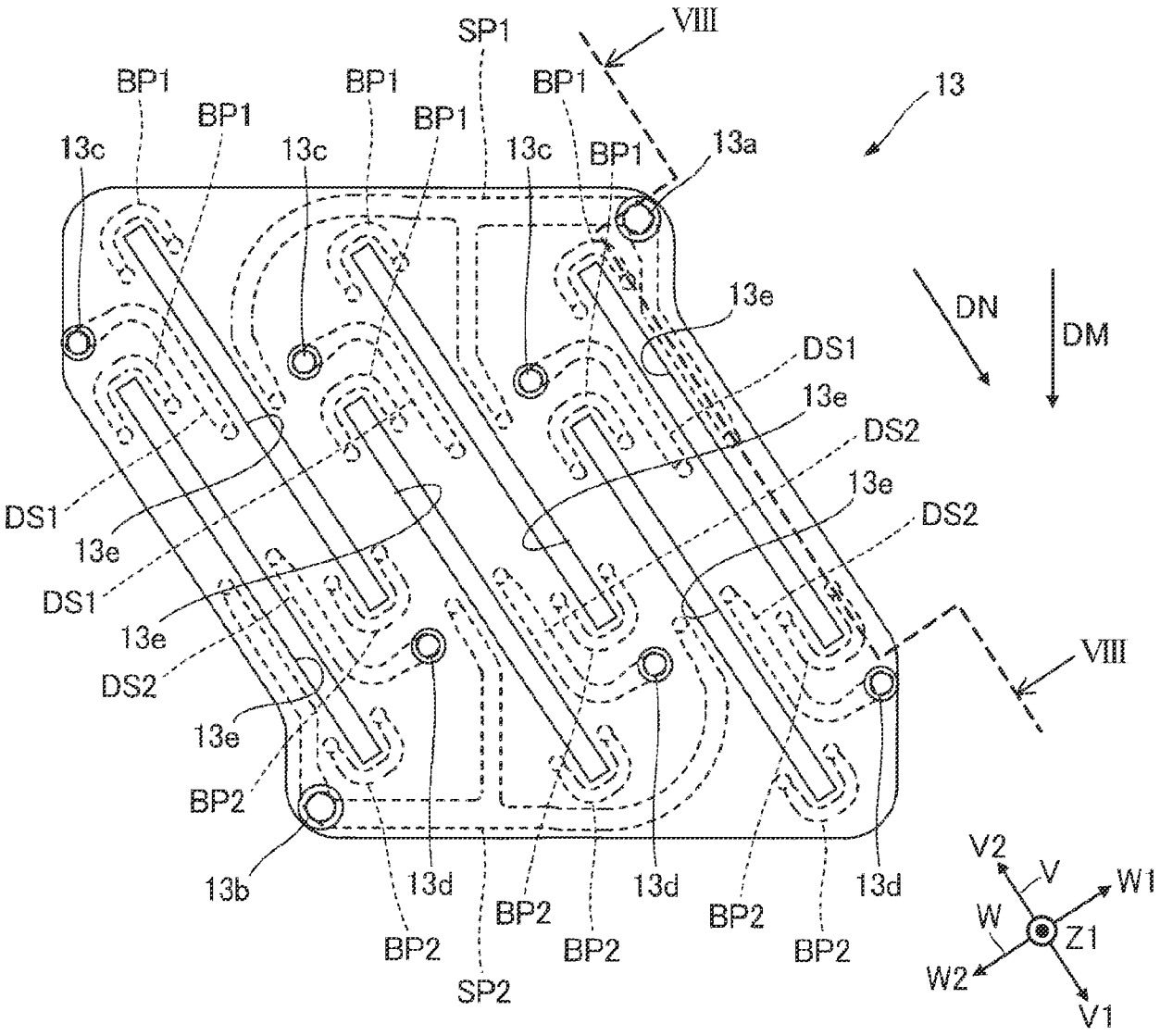
FIG. 6 is a plan view of a holder.
Figure 7:
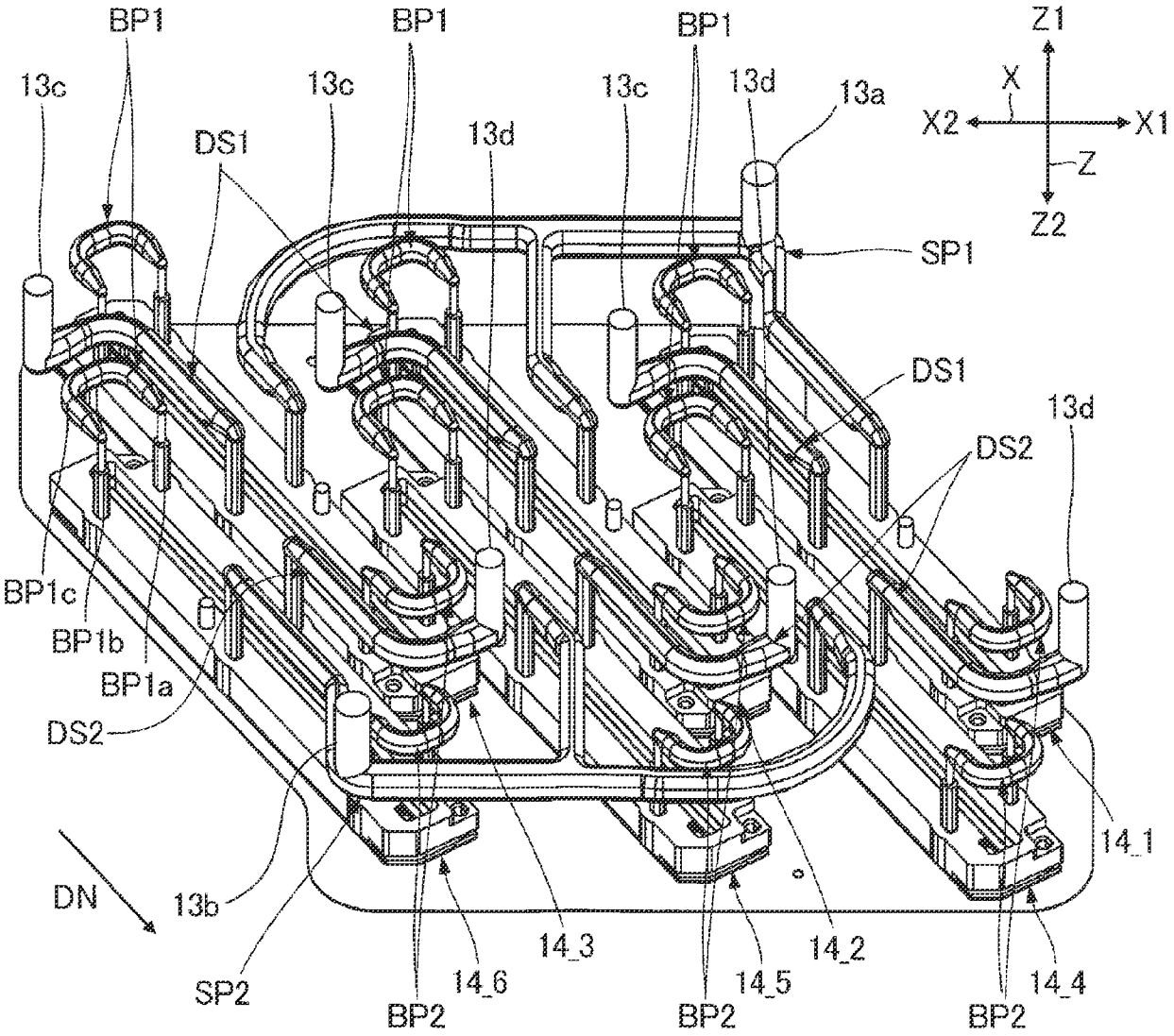
FIG. 7 is a perspective view illustrating a head main body and a flow channel provided in the holder.

FIG. 6 is a plan view of the holder 13. FIG. 7 is a perspective view illustrating the flow channel, which is provided in the holder 13, and the head main body 14. In addition, in FIG. 6, an example of the structure in the holder 13 viewed in the Z2 direction is indicated by the dashed line. FIG. 7 illustrates the fixing plate 15, in addition to the flow channel of the holder 13 and the plurality of head main bodies 14.

As illustrated in FIGS. 6 and 7, inside the holder 13, there are provided the first distribution supply flow channel SP1, the second distribution supply flow channel SP2, three first individual discharge flow channels DS1, three second individual discharge flow channels DS2, six bypass flow channels BP1, and six bypass flow channels BP2.

The first distribution supply flow channel SP1 is a flow channel having three branched portions for supplying the first ink introduced into the coupling tube 13*a* to the three head main bodies 14. The second distribution supply flow channel SP2 is a flow channel having three branched portions for supplying the second ink introduced into the coupling tube 13*b* to the three head main bodies 14.

The first individual discharge flow channel DS1 is provided for each head main body 14 using the first ink, and is a flow channel through which the first ink introduced from the head main body 14 is discharged from the coupling tube 13*c*. The second individual discharge flow channel DS2 is provided for each head main body 14 using the second ink, and is a flow channel through which the second ink introduced from the head main body 14 is discharged from the coupling tube 13*d*.

Each of the bypass flow channel BP1 and the bypass flow channel BP2 is provided for each head main body 14, and is a flow channel which is for communicating the first common liquid chamber R1 and the second common liquid chamber R2 described above. Here, the bypass flow channel BP1 and the bypass flow channel BP2 are located on opposite sides to the center of the first common liquid chamber R1 or the second common liquid chamber R2 in the direction along the X axis. In an example illustrated in FIG. 6, the bypass flow channel BP1 is located in the V2 direction with respect to the bypass flow channel BP2. Each of the bypass flow channel BP1 and the bypass flow channel BP2 has a U-shape as viewed in the direction along the Z axis.

Figure 8:
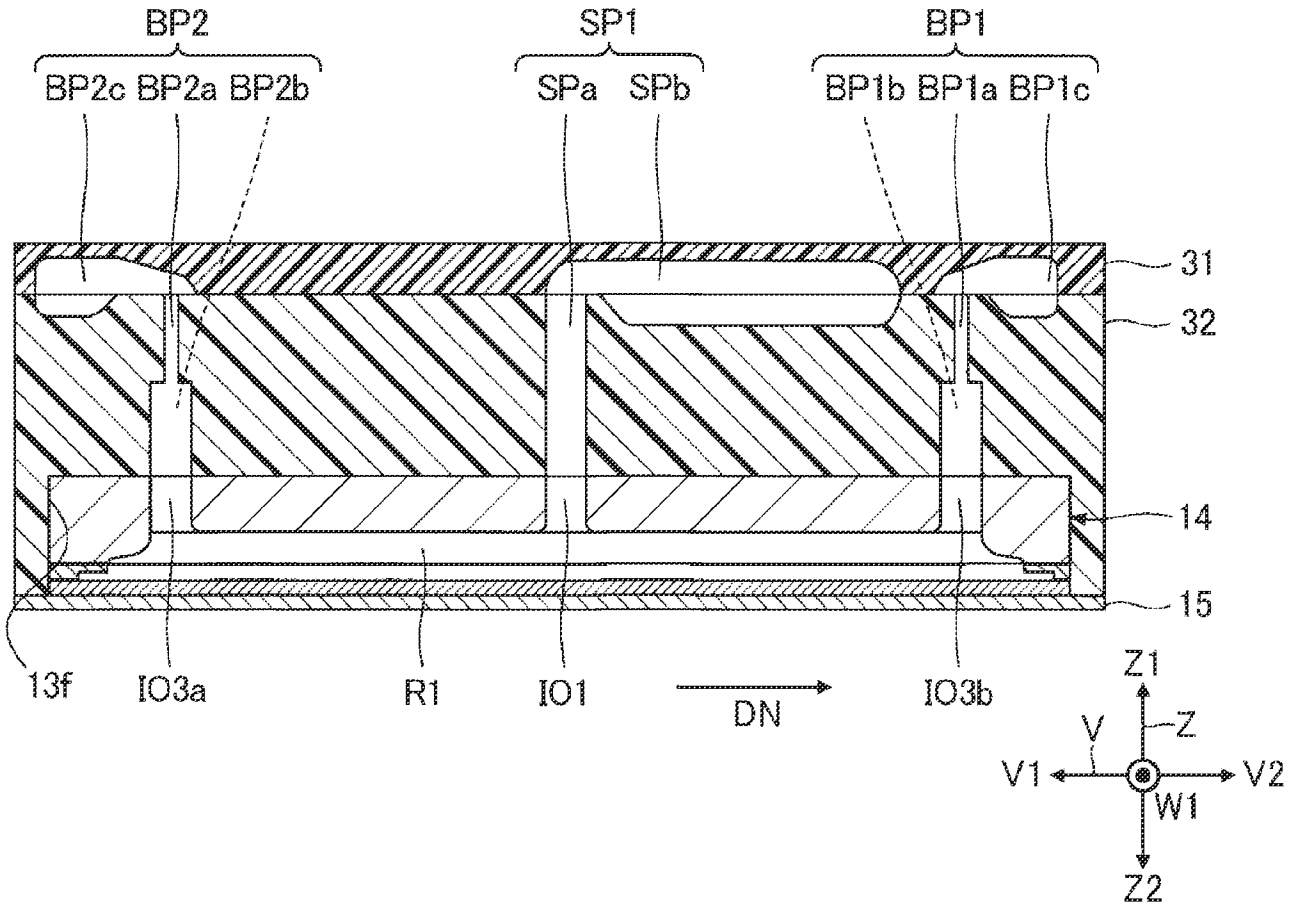
FIG. 8 is a cross-sectional view taken along the line VIII-VIII in FIG. 6.

FIG. 8 is a cross-sectional view taken along the line VIII-VIII in FIG. 6. FIG. 8 illustrates the head main body 14 and the fixing plate 15, in addition to the holder 13. As illustrated in FIG. 8, the holder 13 has a plate shape which extends in a direction perpendicular to the Z axis. The holder 13 has a layer 31 and a layer 32, which are laminated in this order in the Z2 direction. Each of the layer 31 and the layer 32 is made of, for example, a resin material and is formed through injection molding. The layers 31 and 32 are bonded together, for example, with an adhesive.

Each of the above-mentioned flow channels of the holder 13 is provided in a laminate constituted of the layer 31 and the layer 32, and a recess portion 13*f* for accommodating the head main body 14 is provided on a surface of the layer 32 facing the Z2 direction. In an example illustrated in FIG. 8, a thickness of the layer 32 is thicker than the thickness of the layer 31. Therefore, the thickness of the layer 32 necessary for forming the recess portion 13*f* can be easily secured.

Here, the first distribution supply flow channel SP1 has a vertical flow channel SPa and a horizontal flow channel SPb. The vertical flow channel Spa extends in the direction along the Z axis, and is constituted of holes penetrating the layer 32. The horizontal flow channel SPb extends in a direction orthogonal to the Z axis, and is provided between the layer 31 and the layer 32. In the example illustrated in FIG. 8, the horizontal flow channel SPb is constituted of a groove provided on the surface of the layer 31 facing the Z2 direction and a groove provided on the surface of the layer 32 facing the Z1 direction. Although not illustrated in FIG. 8, the second distribution supply flow channel SP2 is also configured in a similar manner as the first distribution supply flow channel SP1.

The bypass flow channel BP1 has a first portion BP1*a*, a second portion BP1*b*, and a third portion BP1*c*. Each of the first portion BP1*a* and the second portion BP1*b* extends in the direction along the Z axis, and is constituted of holes penetrating the layer 32. The third portion BP1*c* extends in a direction orthogonal to the Z axis, and is provided between the layer 31 and the layer 32. In the example illustrated in FIG. 8, the third portion BP1*c* is constituted of a groove provided on a surface of the layer 31 facing the Z2 direction and a groove provided on a surface of the layer 32 facing the Z1 direction.

In a similar manner, the bypass flow channel BP2 has a first portion BP2*a*, a second portion BP2*b*, and a third portion BP2*c*. Each of the first portion BP2*a* and the second portion BP2*b* extends in the direction along the Z axis, and is constituted of holes penetrating the layer 32. The third portion BP2*c* extends in the direction orthogonal to the Z axis, and is provided between the layer 31 and the layer 32. In the example illustrated in FIG. 8, the third portion BP2*c* is constituted of a groove provided on the surface of the layer 31 facing the Z2 direction and a groove provided on the surface of the layer 32 facing the Z1 direction.

1-6. Flow Channel Structure 11

Figure 9:
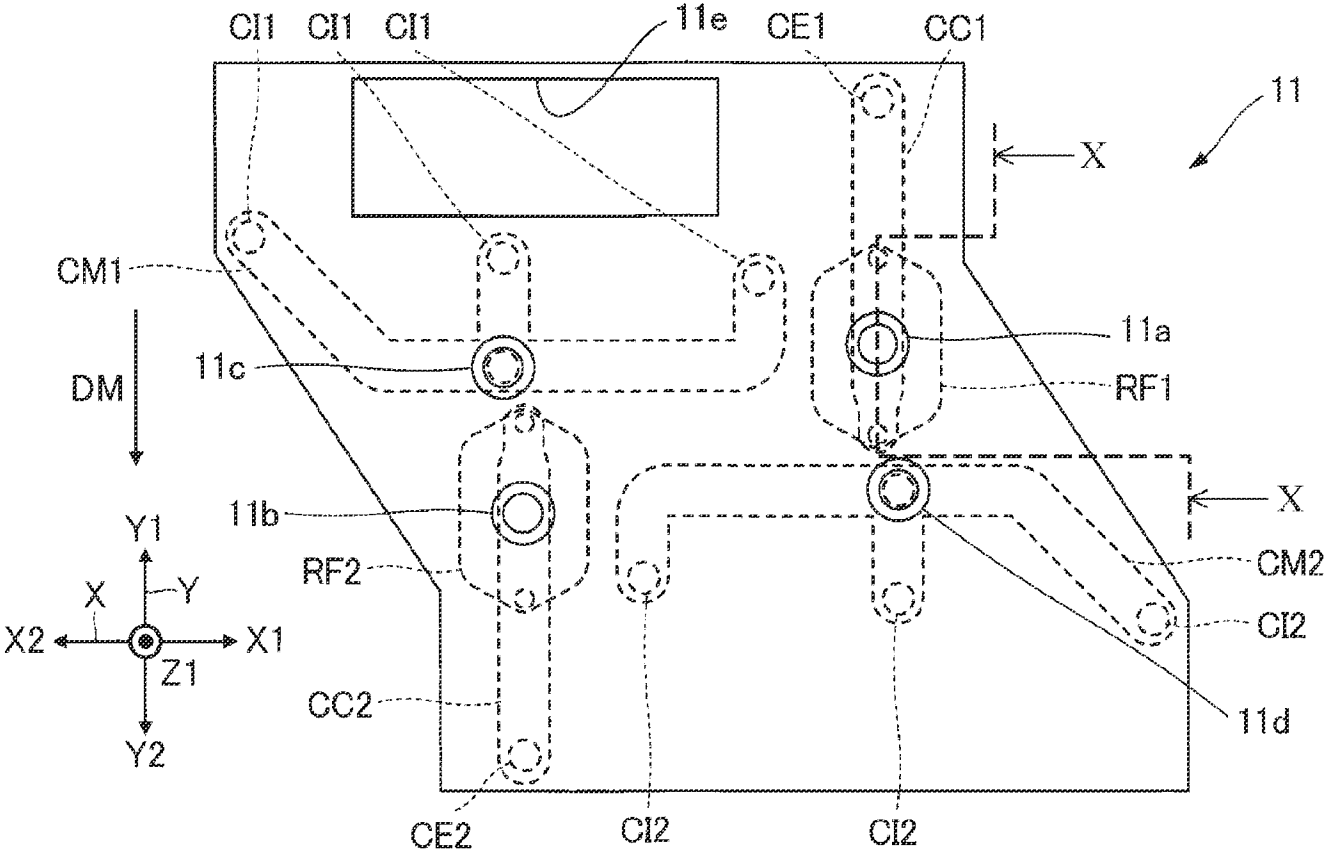
FIG. 9 is a plan view of a flow channel structure.

FIG. 9 is a plan view of the flow channel structure 11. In FIG. 9, an example of the structure in the flow channel structure 11 viewed in the Z2 direction is indicated by the dashed line. As illustrated in FIG. 9, inside the flow channel structure 11, there are provided the first supply flow channel CC1, the second supply flow channel CC2, the first discharge flow channel CM1, the second discharge flow channel CM2, the first filter chamber RF1, and the second filter chamber RF2.

The first supply flow channel CC1 is a flow channel through which the first ink introduced into the coupling tube 11*a* is supplied to the above-mentioned holder 13. Here, the first supply flow channel CC1 communicates with an internal space of the coupling tube 11*a* through the first filter chamber RF1. The discharge port CE1 coupled to the coupling tube 13*a* described above communicates with the first supply flow channel CC1.

The second supply flow channel CC2 is a flow channel through which the second ink introduced into the coupling tube 11*b* is supplied to the above-mentioned holder 13. Here, the second supply flow channel CC2 communicates with an internal space of the coupling tube 11*b* through the second filter chamber RF2. The discharge port CE2 coupled to the coupling tube 13*b* described above communicates with the second supply flow channel CC2.

The first discharge flow channel CM1 is a flow channel through which the first ink is discharged from the holder 13 described above from the coupling tube 11*c*. The introduction port CI1 coupled to the above-mentioned three coupling tubes 13*c* communicates with the first discharge flow channel CM1.

The second discharge flow channel CM2 is a flow channel through which the second ink is discharged from the holder 13 described above from the coupling tube 11*d*. The introduction port CI2 coupled to the above-mentioned three coupling tubes 13*d* communicates with the second discharge flow channel CM2.

Figure 10:
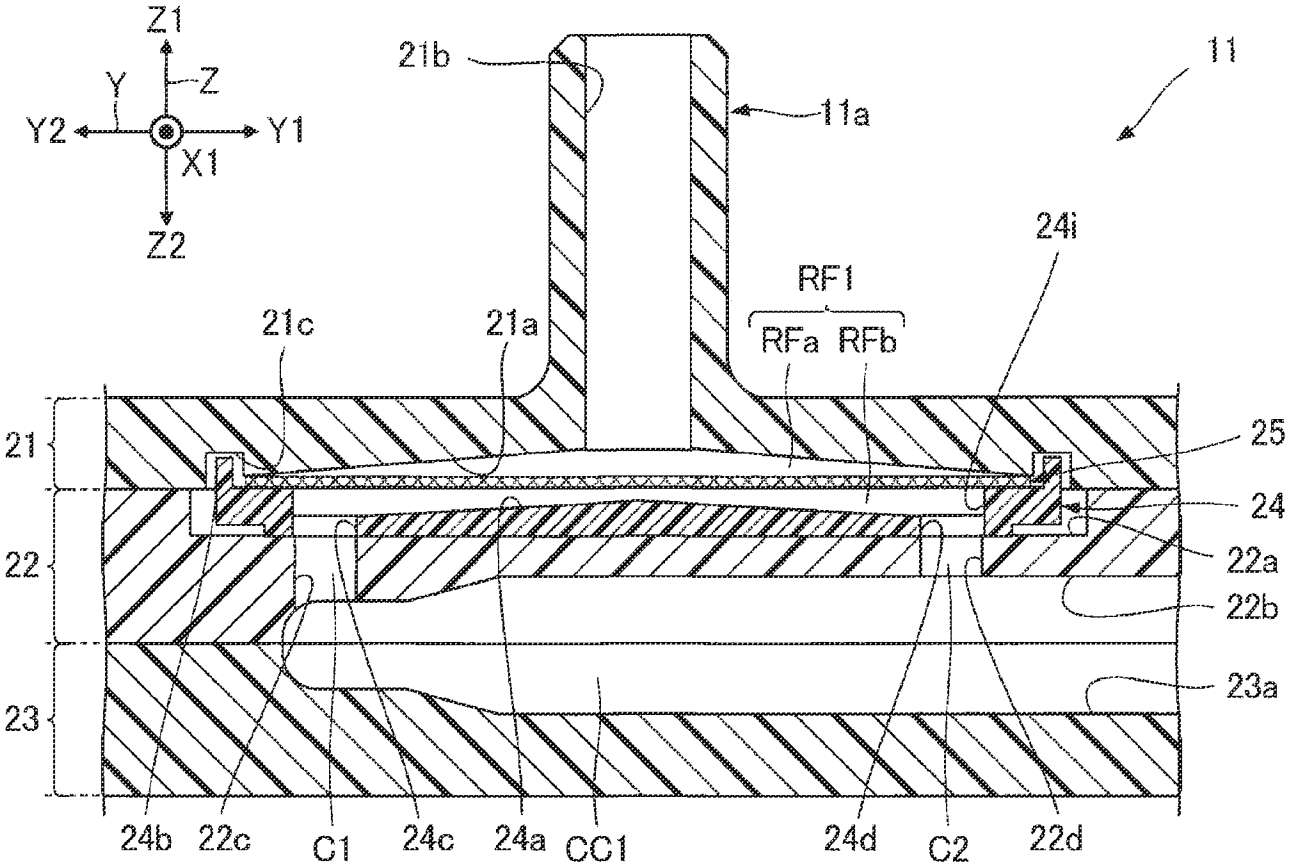
FIG. 10 is a cross-sectional view taken along the line X-X in FIG. 9.

FIG. 10 is a cross-sectional view taken along the line X-X in FIG. 9. FIG. 10 illustrates typically a configuration of the flow channel structure 11 corresponding to the coupling tube 11*a*. The configuration corresponding to the coupling tube lib is the same as the configuration corresponding to the coupling tube 11*a*.

As illustrated in FIG. 10, the flow channel structure 11 has a plate shape which extends in a direction perpendicular to the Z axis. The flow channel structure 11 has the layers 21, 22 and 23, and a fixing member 24 and a filter 25 interposed between the layers 21 and 22.

The layers 21, 22 and 23 are laminated in this order in the Z2 direction. Each of the layers 21, 22 and 23 is made of, for example, a resin material, and is formed through injection molding. The layers 21, 22 and 23 are bonded together, for example, with an adhesive. Thicknesses of the layers 21, 22 and 23 along the Z axis may be the same or different from each other.

The layer 21 is provided with a concave surface 21*a*, an introduction port 21*b*, and a groove 21*c*. The concave surface 21*a* is provided on a surface of the layer 21 facing the Z2 direction, and constitutes a portion of the wall surface of the first filter chamber RF1. In an example illustrated in FIG. 10, the concave surface 21*a* has a shape which continuously deepens toward the introduction port 21*b*. The introduction port 21*b* is a through hole which opens into the concave surface 21*a* and communicates with an internal space of the coupling tube 11*a*. In the example illustrated in FIG. 10, the coupling tube 11*a* is integrally formed with the layer 21. Therefore, the coupling tube 11*a* is made of a resin material like the layer 21. The groove 21*c* is provided along the outer periphery of the concave surface 21*a* on a surface of the layer 21 facing the Z2 direction, and constitutes a space for accommodating a portion of the fixing member 24 described later. The groove 21*c* can also function as a roll-off portion for the adhesive.

The coupling tube 11*a* may be formed separately from the layer 21. In such a case, the coupling tube 11*a* may be made of a metal material or the like, and is fixed to the layer 21 with an adhesive or the like. The groove 21*c* may be provided as needed and may be removed. Further, similarly to the coupling tube 11*a*, the coupling tubes 11*b* to 11*c* may be integrally formed with the layer 21 or may be formed separately from the layer 21.

The layer 22 is provided with a recess portion 22*a*, a groove 22*b*, a hole 22*c*, and a hole 22*d*. The recess portion 22*a* is provided on a surface of the layer 22 facing the Z1 direction, and constitutes a space for accommodating a portion of the fixing member 24 to be described later. The groove 22*b* is provided on a surface of the layer 22 facing the Z2 direction, and constitutes a portion of the first supply flow channel CC. In the example illustrated in FIG. 10, the first supply flow channel CC1 extends along the Y axis and has a shape having a portion in which an area in the XZ plane becomes narrower in the Y2 direction. Each of the hole 22*c* and the hole 22*d* is a hole which opens in the recess portion 22*a* and the groove 22*b* and penetrates the layer 22. In the example illustrated in FIG. 10, the hole 22*c* is coupled to the end of the groove 22*b* in the Y2 direction. The hole 22*d* is coupled to the groove 22*b* at a position in the Y1 direction with respect to the hole 22*c*.

The layer 23 is provided with a groove 23*a*. The groove 23*a* is provided on a surface of the layer 23 facing the Z1 direction, and constitutes a portion of the first supply flow channel CC. In the example illustrated in FIG. 10, the groove 23*a* has a shape which extends along the Y axis. In the example illustrated in FIG. 10, the groove 22*b* of the layer 22 and the groove 23*a* of the layer 23 may constitute the first supply flow channel CC1, but one of the groove 22*b* and the groove 23*a* may constitute the first supply flow channel CC1.

The fixing member 24 is a substantially plate-shaped member which fixes the filter 25 to at least one of the layer 21 or the layer 22 and constitutes a portion of the wall surface of the first filter chamber RF1. In the example illustrated in FIG. 10, the fixing member 24 is provided in the recess portion 22*a* described above. The fixing member 24 is made of, for example, a resin material and is formed through injection molding. Here, the filter 25 can be fixed to the fixing member 24 by forming the fixing member 24 through insert molding using the filter 25 as an insert product. The fixing member 24 is fixed to at least one of the layer 21 or the layer 22 by an adhesive, for example.

In such a manner, by fixing the filter 25 to at least one of the layer 21 or the layer 22 through the fixing member 24, as compared with a configuration in which the filter 25 is directly fixed to at least one of the layer 21 or the layer 22, it is possible to widen a selection range of the constituent materials of the layer 21 and the layer 22 and reduce a frequency of the unintentional adhesion of the adhesive to the filter 25. The constituent materials of the fixing member 24 may be the same as or different from the constituent materials of the layer 21 or the layer 22.

The fixing member 24 is provided with a bottom wall 24*a*, a frame portion 24*b*, a first discharge port 24*c*, and a second discharge port 24*d*.

The bottom wall 24*a* is provided on a surface of the fixing member facing the Z1 direction, and constitutes a portion of the wall surface of the first filter chamber RF1. In the example illustrated in FIG. 10, the bottom wall 24*a* has a shape which is continuously deepened toward each of the first discharge port 24*c* and the second discharge port 24*d*. The frame portion 24*b* is an annular wall portion along an outer peripheral edge of the bottom wall 24*a*, and constitutes a side wall of the first filter chamber RF1. More specifically, a portion of the inner peripheral surface of the frame portion 24*b* constitutes the side wall 24*i* of the downstream chamber RFb. In the example illustrated in FIG. 10, a portion of the frame portion 24*b* is inserted into the groove 21*c* described above. Through the insertion, the fixing member 24 is positioned with respect to the layer 21. Further, a gap is formed between an outer peripheral surface of the frame portion 24*b* and the recess portion 22*a*. The gap is able to serve as a roll-off portion for the adhesive. Each of the first discharge port 24*c* and the second discharge port 24*d* is a hole which opens into the bottom wall 24*a* and penetrates the fixing member 24. The first discharge port 24*c* is coupled to the above-mentioned hole 22*c* and constitutes the first flow channel C1 together with the hole 22*c*. The second discharge port 24*d* is coupled to the above-mentioned hole 22*d* and constitutes the second flow channel C2 together with the hole 22*d*.

The filter 25 is a plate-shaped or sheet-shaped member which captures foreign matter and the like mixed in the ink while causing the ink to pass therethrough. The filter 25 is made of a metal fiber such as a twill weave or a flat tatami mat weave. The filter 25 is not limited to a structure using the metal fiber, and may be made of a resin fiber such as non-woven fabric, for example. The filter 25 is typically disposed so as to be parallel to the nozzle surface FN. Here, the filter 25 may be provided so as to be inclined in a range of 0 degrees or more and 45 degrees or less with respect to the nozzle surface FN.

The filter 25 is fixed to the frame portion 24*b* of the fixing member 24 described above. Here, the first filter chamber RF1 is divided into an upstream chamber RFa and a downstream chamber RFb by the filter 25. The upstream chamber RFa is located in the Z1 direction with respect to the filter 25, and is a space having the concave surface 21*a* as a portion of the wall surface. The downstream chamber RFb is located in the Z2 direction with respect to the filter 25, and is a space having the side wall 24*i* and the bottom wall 24*a* as a portion of the wall surface.

Figure 11:
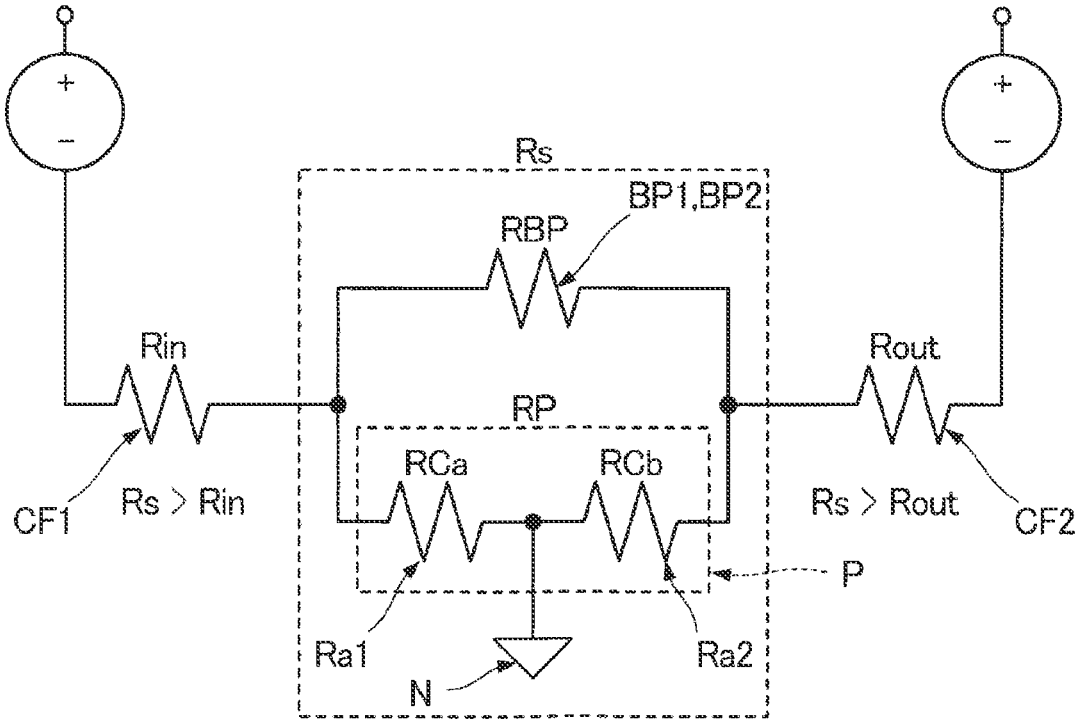
FIG. 11 is an equivalent circuit diagram of a flow channel provided in the liquid ejecting head.

FIG. 11 is an equivalent circuit diagram of a flow channel provided in the liquid ejecting head 10. FIG. 11 illustrates a flow channel resistance of each section of the flow channel.

As described above, the liquid ejecting head 10 has the plurality of individual flow channels P, the common supply flow channel CF1, the common discharge flow channel CF2, and the bypass flow channels BP1 and BP2. The nozzle N is provided in each of the plurality of individual flow channels P. Through the common supply flow channel CF1, the ink, which is an example of a "liquid", is supplied to the plurality of individual flow channels P. Through the common discharge flow channel CF2, the ink is discharged from the plurality of individual flow channels P. Through the bypass flow channels BP1 and BP2, the plurality of individual flow channels P are bypassed, and the common supply flow channel CF1 and the common discharge flow channel CF2 communicate with each other.

Here, a combined flow channel resistance Rs of the bypass flow channels BP1 and BP2 and the plurality of individual flow channels P is greater than a flow channel resistance Rin of the common supply flow channel CF1, and is greater than a flow channel resistance Rout of the common discharge flow channel CF2. Hereinafter, an effect of having such a magnitude relationship between the combined flow channel resistance Rs, the flow channel resistance Rin, and the flow channel resistance Rout will be described.

In the liquid ejecting head 10, image quality can be improved by disposing the nozzles N at a high density, but it is necessary to increase the density of the individual flow channels P accordingly. Therefore, in order to improve the image quality, the cross-sectional area of the individual flow channels P has to be made small, and the liquid cannot be sufficiently circulated and a viscosity of the ink cannot be suitably reduced when the bypass flow channels BP1 and BP2 are not provided in the liquid ejecting head 10.

On the other hand, by providing the bypass flow channels BP1 and BP2 in the liquid ejecting head 10 and reducing the flow channel resistance RBP of the bypass flow channels BP1 and BP2, the combined flow channel resistance Rs of the plurality of individual flow channels P and the bypass flow channels BP1 and BP2 also decreases. Therefore, when a total flow rate of the ink circulated by the circulating mechanism 150 is increased to some extent, it is possible to suitably reduce the viscosity of the ink. The flow channel resistance RBP is a combined flow channel resistance of the bypass flow channel BP1 and the bypass flow channel BP2.

However, when only the reduction in viscosity of the ink is emphasized and the flow channel resistance RBP of the bypass flow channels BP1 and BP2 is excessively small, the combined flow channel resistance Rs of the plurality of individual flow channels P and the bypass flow channels BP1 and BP2 is less than the flow channel resistance Rin of the common supply flow channel CF1 or the flow channel resistance Rout of the common discharge flow channel CF2. Then, the flow channel resistance of the flow channel in the liquid ejecting head 10 is rate-determined by the flow channel resistance Rin of the common supply flow channel CF1 or the flow channel resistance Rout of the common discharge flow channel CF2. On the other hand, each of the common supply flow channel CF1 and the common discharge flow channel CF2 is commonly coupled to the plurality of individual flow channels P. Therefore, in general, it is necessary for each of the common supply flow channel CF1 and the common discharge flow channel CF2 to have a certain amount of flow rate. Therefore, the cross-sectional area has to be large to some extent. Therefore, the flow channel resistance Rin and the flow channel resistance Rout decrease to some extent. As described above, when the flow channel resistance RBP of the bypass flow channels BP1 and BP2 is excessively small, the flow channel resistance Rin and the flow channel resistance Rout are rate-determining factors of the flow channel resistance of the flow channel in the liquid ejecting head 10. Therefore, as a result of a decrease in the flow channel resistance Rin or the flow channel resistance Rout, there are problems in that an amount of ink circulated by the circulating mechanism 150 increases and the capacity or number of pumps used in the circulating mechanism 150 has to be increased.

On the other hand, although there are the above-mentioned difficulties, when each of the flow channel resistance Rin and the flow channel resistance Rout can be increased, the ink circulation flow rate itself circulated by the circulating mechanism 150 can be decreased. However, in such a case, the amount of ink flowing in the individual flow channel P is naturally decreased. Therefore, the effect of reducing the viscosity of the ink cannot be suitably obtained.

Therefore, in the liquid ejecting head 10, the flow channel resistances of the bypass flow channels BP1 and BP2 are adjusted such that the combined flow channel resistance Rs, which is the flow channel resistance of the combined flow channel constituted of the bypass flow channels BP1 and BP2 and the plurality of individual flow channels P, is greater than each of the flow channel resistance Rin of the common supply flow channel CF1 and the flow channel resistance Rout of the common discharge flow channel CF2. By adjusting the flow channel resistances of the bypass flow channels BP1 and BP2 in such a manner, it is not necessary to increase the total circulation flow rate of the ink circulated by the circulating mechanism 150. Therefore, it is not necessary to increase the capacity or number of the pumps used for the circulating mechanism 150. It is not necessary to decrease the flow rate flowing through the individual flow channels P to that extent. Therefore, the effect of reducing the viscosity of the ink can be suitably obtained.

Here, it is preferable that the combined flow channel resistance Rs of the bypass flow channels BP1 and BP2 and the plurality of individual flow channels P is equal to or greater than 50% and equal to or less than 70% relative to a combined flow channel resistance Rall of the bypass flow channels BP1 and BP2, the plurality of individual flow channels P, the common supply flow channel CF1, and the common discharge flow channel CF2, that is, a flow channel resistance of the entire flow channel of the liquid ejecting head 10. As described above, the combined flow channel resistance Rs, which is the flow channel resistance of the combined flow channel constituted of the bypass flow channels BP1 and BP2 and the plurality of individual flow channels P, may be greater than each of the flow channel resistance Rin of the common supply flow channel CF1 and the flow channel resistance Rout of the common discharge flow channel CF2. In such a case, the minimum value and the maximum value of the combined flow channel resistance Rs are as follows when examined in units of 1%. The minimum value of the combined flow channel resistance Rs is 34% relative to the combined flow channel resistance Rall (the flow channel resistances of the common supply flow channel CF1 and the common discharge flow channel CF2 each are 33%). The maximum value of the combined flow channel resistance Rs is 98% relative to the combined flow channel resistance Rall (the flow channel resistances of the common supply flow channel CF1 and the common discharge flow channel CF2 each are 1%). That is, when the combined flow channel resistance Rs is equal to or greater than 34% and equal to or less than 98% relative to the combined flow channel resistance Rall, the effect of the present disclosure can be obtained. However, in practice, the common supply flow channel CF1 and the common discharge flow channel CF2 may become the rate-determining factor of the ink flow in the entire flow channel of the liquid ejecting head 10. In such a case, even when the flow channel resistances of the plurality of individual flow channels P and the bypass flow channels BP1 and BP2 are adjusted as in each embodiment, there is a possibility that the total flow rate of the ink cannot be appropriately controlled. Therefore, it is preferable that the combined flow channel resistance of the common supply flow channel CF1 and the common discharge flow channel CF2 is made less than 50% of the combined flow channel resistance Rall, in other words, the combined flow channel resistance Rs is made equal to or greater than 50% of the combined flow channel resistance Rall. On the other hand, when the combined flow channel resistance Rs is excessively large, the flow rate of the ink flowing through the plurality of individual flow channels P and the bypass flow channels BP1 and BP2 is extremely limited. As a result, there is a possibility that the viscosity of the ink is not sufficiently reduced depending on the type of ink. Specifically, when the combined flow channel resistance Rs is equal to or less than 70% of the combined flow channel resistance Rall, the viscosity of the ink could be suitably reduced in various inks. That is, in the present disclosure, it is necessary for the combined flow channel resistance Rs to be equal to or greater than 34% and equal to or less than 98% relative to the combined flow channel resistance Rall. However, it is particularly preferable that the combined flow channel resistance Rs is equal to or greater than 50% and equal to or less than 70%. The effect of 50% or more and 70% or less can be obtained in Examples 2, 3, 4, 5, 6, 12, 13, 14, and 15 among the examples in Table 1 to be described later. The examples correspond to those in which "A" is noted in the "Others" column shown in Table 1.

It is preferable that the flow channel resistance RBP of the bypass flow channels BP1 and BP2 is less than the combined flow channel resistance RP of the plurality of individual flow channels P. The flow channel resistance RBP of the bypass flow channels BP1 and BP2 is more preferably equal to or greater than 25% and equal to or less than 55% relative to the combined flow channel resistance RP of the plurality of individual flow channels P. When the flow channel resistance RBP of the bypass flow channels BP1 and BP2 is excessively small with respect to the combined flow channel resistance RP of the plurality of individual flow channels P, an excessively large amount of ink flows in the bypass flow channels BP1 and BP2 than in the individual flow channels P. Therefore, there is a possibility that the total flow rate has to be increased in order to remove air bubbles mixed in the individual flow channel P. On the other hand, when the flow channel resistance RBP of the bypass flow channels BP1 and BP2 is excessively large with respect to the combined flow channel resistance RP of the plurality of individual flow channels P, the flow channel resistance of the individual flow channels P is relatively small. Therefore, the cross-sectional area of the individual flow channel P increases to some extent, and the density of the nozzle N decreases. As a result, there is a possibility that favorable image quality cannot be obtained. In order to preferably achieve both high density of the nozzle N and reduction of the total flow rate of the ink circulated by the circulating mechanism 150, it is preferable that the flow channel resistance RBP of the bypass flow channels BP1 and BP2 is less than the combined flow channel resistance RP of the plurality of individual flow channels P. The effect can be obtained in Examples 1, 2, 3, 4, 5, 6, 7, 8, 9, 12, 13, 14, and 15 among the examples in Table 1 to be described later. The examples correspond to those in which "B" is noted in the "Others" column shown in Table 1. In order to more preferably achieve both high density of the nozzle N and reduction of the total flow rate of the ink circulated by the circulating mechanism 150, it is more preferable that the flow channel resistance RBP of the bypass flow channels BP1 and BP2 is equal to or greater than 25% and equal to or less than 55% relative to the combined flow channel resistance RP of the plurality of individual flow channels P. The effect can be obtained in Examples 2, 3, 4, 5, 6, 7, 12, 13, 14, and 15 among the examples in Table 1 to be described later. The examples correspond to those in which "C" is noted in the "Others" column shown in Table 1.

As described above, each of the plurality of individual flow channels P includes the pressure chamber C which applies pressure to eject the ink from the nozzle N, the individual supply flow channel Ra1 through which the ink is supplied to the pressure chamber C, and the individual discharge flow channel Ra2 through which the ink is discharged from the pressure chamber C.

Here, it is preferable that the flow channel resistance RBP of the bypass flow channels BP1 and BP2 is less than the combined flow channel resistance RCa of the individual supply flow channels Ra1 included in the plurality of individual flow channels P. In such a case, the total flow rate of the ink circulated by the circulating mechanism 150 can be suitably decreased.

It is preferable that the flow channel resistance RBP of the bypass flow channels BP1 and BP2 is less than the combined flow channel resistance RCb of the plurality of individual discharge flow channels Ra2. In such a case, the total flow rate of the ink circulated by the circulating mechanism 150 can be suitably decreased.

The effect of making the flow channel resistance RBP of the bypass flow channels BP1 and BP2 less than the combined flow channel resistance RCa of the plurality of individual supply flow channels Ra1 and the combined flow channel resistance RCb of the plurality of individual discharge flow channels Ra2 can be obtained in Examples 1, 2, 3, 4, 5, 6, 7, 12, 13, 14, and 15 of the examples in Table 1 to be described later. The examples correspond to those in which "D" is noted in the "Others" column shown in Table 1.

It is preferable that the flow channel resistances of the individual supply flow channels Ra1 included in the plurality of individual flow channels P and the flow channel resistances of the individual discharge flow channels Ra2 included in the plurality of individual flow channels P are substantially equal to each other. The flow channel resistances of the individual supply flow channel Ra1 and the individual discharge flow channel Ra2 may be different. In such a case, even when the piezoelectric element 14*e* is driven in a similar manner, variations occur in the flow (momentum) of the liquid until the liquid reaches the nozzles through the pressure chamber Ca and the pressure chamber Cb. Therefore, it may be necessary to make adjustments such as different driving of the piezoelectric element 14*e* between the pressure chamber Ca and the pressure chamber Cb. By making the flow channel resistances substantially equal, the adjustment can be omitted. The effect can be obtained in Examples 1, 2, 3, 4, 5, 6, 7, 8, 9, 10 and 11 among the examples in Table 1 to be described later. The examples correspond to those in which "E" is noted in the "Others" column shown in Table 1.

The magnitude relationship between the flow channel resistance Rin of the common supply flow channel CF1 and the flow channel resistance Rout of the common discharge flow channel CF2 is not particularly limited. However, it is preferable that the flow channel resistance Rin of the common supply flow channel CF1 is greater than the flow channel resistance Rout of the common discharge flow channel CF2. For example, when the filter 25, which is an element for increasing the flow channel resistance, is provided in the common supply flow channel CF1 as described above and recovers foreign matter toward the nozzle N, the flow channel resistance Rin of the common supply flow channel CF1 tends to be large. On the other hand, the common discharge flow channel CF2 is on the downstream of the nozzle N. Therefore, the effect of providing the filter 25 is lower than the effect of the common supply flow channel CF1, and rather, the cost can be decreased by not providing the filter 25. At this time, the flow channel resistance Rin is greater than the flow channel resistance Rout depending on presence or absence of the filter. The effect can be obtained in Examples 1, 2, 3, 5, 7, 8, 9, 10, and 11 among the examples in Table 1 to be described later. The examples correspond to those in which "F" is noted in the "Others" column shown in Table 1.

The flow channel resistance RBP of the bypass flow channels BP1 and BP2 differs depending on the type of ink used and the like, and may satisfy the magnitude relationship of the combined flow channel resistance Rs, the flow channel resistance Rin and the flow channel resistance Rout as described above. Though not particularly limited, for example, when the viscosity of the ink is 6.00 [m·Pa/s], it is preferable that the flow channel resistance RBP is equal to or greater than $2.23\times10^{10}$ [N·s/m$^5$] and equal to or less than $6.69\times10^{10}$ [N·s/m$^5$]. When the flow channel resistance RBP is within such a range, bypass flow channels BP1 and BP2 suitable for using general ink can be obtained.

The combined flow channel resistance Rs of the bypass flow channels BP1 and BP2 and the plurality of individual flow channels P differs depending on the type of ink used and the like, and may satisfy the magnitude relationship of the combined flow channel resistance Rs, the flow channel resistance Rin and the flow channel resistance Rout as described above. Though not particularly limited, for example, when the viscosity of the ink is 6.00 [m·Pa/s], it is preferable that the flow channel resistance RBP is equal to or greater than $1.67\times10^{10}$ [N·s/m$^5$] and equal to or less than $5.02\times10^{10}$ [N·s/m$^5$]. When the combined flow channel resistance Rs is within such a range, the bypass flow channels BP1 and BP2 and individual flow channels P suitable for using a general ink can be obtained.

The flow channel resistance Rin of the common supply flow channel CF1 differs depending on the type of ink used and the like, and may satisfy the magnitude relationship of the combined flow channel resistance Rs, the flow channel resistance Rin and the flow channel resistance Rout as described above. Though not particularly limited, for example, when the viscosity of the ink is 6.00 [m·Pa/s], it is preferable that the flow channel resistance RBP is equal to or greater than $9.76\times10^{9}$ [N·s/m$^5$] and equal to or less than $2.93\times10^{10}$ [N·s/m$^5$]. When the flow channel resistance Rin is within such a range, the common supply flow channel CF1 suitable for using a general ink can be obtained.

The flow channel resistance Rout of the common discharge flow channel CF2 differs depending on the type of ink used and the like, and may satisfy the magnitude relationship of the combined flow channel resistance Rs, the flow channel resistance Rin and the flow channel resistance Rout as described above. Though not particularly limited, for example, when the viscosity of the ink is 6.00 [m·Pa/s], it is preferable that the flow channel resistance RBP is equal to or greater than $1.39\times10^{9}$ [N·s/m$^5$] and equal to or less than $4.18\times10^{9}$ [N·s/m$^5$]. When the flow channel resistance Rout is within such a range, the common discharge flow channel CF2 suitable for using a general ink can be obtained.

As described above, the bypass flow channel BP1 has a first portion BP1*a*, a second portion BP1*b*, and a third portion BP1*c*. The first portion BP1*a* extends along the Z1 direction or the Z2 direction, which is an example of the "first direction", and couples to the common supply flow channel CF1. The second portion BP1*b* extends along the Z1 direction or the Z2 direction and couples to the common discharge flow channel CF2. The third portion BP1*c* extends along a plane parallel to both the X1 or X2 direction, which is an example of the "second direction", and the Y1 or Y2 direction, which is an example of the "third direction", and couples to each of the first portion BP1*a* and the second portion BP1*b*. Here, the "first direction" is a direction in which the ink is ejected from the nozzle N. The "second direction" is a direction orthogonal to the "first direction". The "third direction" is a direction orthogonal to both the "first direction" and the "second direction".

In such a bypass flow channel BP1, a bent or curved portion is provided between each of the first portion BP1*a* and the second portion BP1*b* and the third portion BP1*c*. Therefore, there is an advantage in that the flow channel resistance can be easily increased. Further, at least a portion of the bypass flow channels BP1 and BP2 can be provided in the holder 13 which is a member different from the head main body 14. As described above, the bypass flow channel BP2 has a first portion BP2*a*, a second portion BP2*b*, and a third portion BP2*c*, is configured in a similar manner as the bypass flow channel BP1, and therefore has the same effect as the bypass flow channel BP1.

Here, as described above, the third portion BP1*c* has a U-shape as viewed in the Z1 direction or the Z2 direction. The third portion BP1*c* having such a shape has an advantage in that the flow channel resistance can be easily increased.

It is preferable that the flow channel resistance of each of the first portion BP1*a* and the second portion BP1*b* is greater than the flow channel resistance of the third portion BP1*c*. Each of the first portion BP1*a* and the second portion BP1*b* extends along the Z1 direction or the Z2 direction, which is the thickness direction of the holder 13. Therefore, it is relatively easy to decrease the cross-sectional area with high accuracy. Therefore, by making each flow channel resistance of the first portion BP1*a* and the second portion BP1*b* greater than the flow channel resistance of the third portion BP1*c*, it is possible to easily manufacture the bypass flow channel BP1 having the desired flow channel resistance.

As described above, the liquid ejecting apparatus 100 includes a liquid ejecting head 10 and a control unit 120 which is an example of a "control section" for controlling the ink ejection operation by the liquid ejecting head 10.

In the present embodiment, the control unit 120 controls not only an ejection operation of ejecting ink from the liquid ejecting head 10 but also a recovery operation of recovering the state of the liquid ejecting head 10 and a filling operation of filling the liquid ejecting head 10 with the ink. Here, the ejection operation is, for example, an operation of printing an image based on the image information on the medium M by operating the liquid ejecting head 10 based on the image information. The recovery operation is, for example, an operation in which the ink ejection characteristic of the liquid ejecting head 10 is brought closer to the target characteristic by reducing an increase in viscosity of the ink in the liquid ejecting head 10 by operating the circulating mechanism 150. The filling operation is, for example, an operation of filling the liquid ejecting head 10 with the ink by operating the circulating mechanism 150 at the time of initial use of the liquid ejecting head 10.

Here, as described above, the liquid ejecting apparatus 100 has a circulating mechanism 150, and the control unit 120 controls an operation of the circulating mechanism 150. Specifically, the control unit 120 controls the operation of the circulating mechanism 150 so as to make the flow rate of the ink, which is circulated by the circulating mechanism 150, per unit time during the recovery operation or the filling operation greater than the flow rate per unit time of the ink circulated by the circulating mechanism 150 during the ejection operation. Hereinafter, the operation of the liquid ejecting apparatus 100 will be described.

Figure 12:
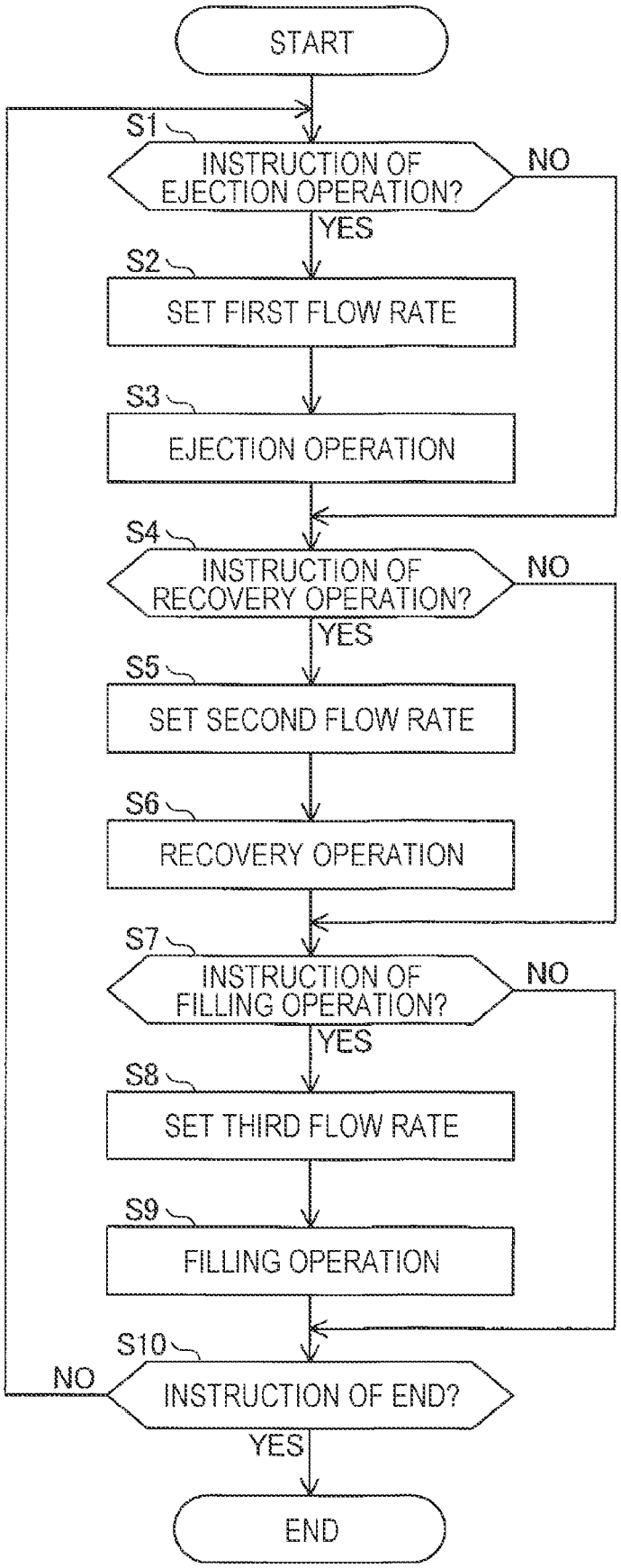
FIG. 12 is a flowchart illustrating an example of an operation of the liquid ejecting apparatus according to the embodiment.

FIG. 12 is a flowchart illustrating an example of an operation of the liquid ejecting apparatus 100 according to the embodiment. First, as illustrated in FIG. 12, the control unit 120 determines in step S1 whether or not there is an instruction for the ejection operation. This instruction is given, for example, by operating a user to an input device such as an operation panel (not illustrated).

When there is an instruction of the ejection operation, the control unit 120 sets the flow rate of the ink, which is circulated by the circulating mechanism 150, per unit time as the first flow rate in step S2.

Thereafter, the control unit 120 performs the ejection operation in step S3. At the time of this ejection operation, the control unit 120 controls the operation of the circulating mechanism 150 so as to have the first flow rate which is set in step S2 described above. Here, from the viewpoint of realizing stable ejection characteristics, it is preferable that the first flow rate is constant over the period of execution of the ejection operation.

On the other hand, when there is no instruction for the ejection operation or after the ejection operation is completed, the control unit 120 determines in step S4 whether or not there is an instruction for the recovery operation. This instruction is given, for example, by operating a user to an input device such as an operation panel (not illustrated).

When instructed to perform the recovery operation, the control unit 120 sets the flow rate of the ink, which is circulated by the circulating mechanism 150, per unit time as a second flow rate in step S5. This second flow rate is a larger amount than the above-mentioned first flow rate.

Thereafter, the control unit 120 performs the recovery operation in step S6. At the time of the recovery operation, the control unit 120 controls the operation of the circulating mechanism 150 so as to have the second flow rate which is set in step S5 described above. The recovery operation is performed for a predetermined period until the ink ejection characteristics of the liquid ejecting head 10 are desired. Here, the second flow rate may be greater than the first flow rate. However, it is preferable that the ink is not ejected from the nozzle N. In addition, it is preferable that the second flow rate is constant over the period of execution of the recovery operation from the viewpoint of preventing the ink from being ejected from the nozzle N.

On the other hand, when there is no instruction for the recovery operation or after the recovery operation is completed, the control unit 120 determines in step S7 whether or not there is an instruction for the filling operation. This instruction is given, for example, by operating a user to an input device such as an operation panel (not illustrated).

When there is an instruction of the filling operation, the control unit 120 sets the flow rate of the ink, which is circulated by the circulating mechanism 150, per unit time as a third flow rate in step S8. This third flow rate is a larger amount than the above-mentioned first flow rate. Here, the third flow rate may be the same as or different from the second flow rate, but is preferably equal to or greater than the second flow rate. In such a case, it is possible to shorten the period necessary for the filling operation and prevent ink from leaking from the nozzle N during the recovery operation.

Thereafter, the control unit 120 performs the filling operation in step S9. At the time of the filling operation, the control unit 120 controls the operation of the circulating mechanism 150 so as to have the third flow rate which is set in step S8 described above. The filling operation is performed for a predetermined period until the liquid ejecting head 10 is filled with a predetermined amount of ink. Here, the third flow rate may be greater than the first flow rate, and may be constant or change over the period of execution of the filling operation.

On the other hand, when there is no instruction for the filling operation or after the filling operation is completed, the control unit 120 determines in step S10 whether or not there is an end instruction. The end instruction is given, for example, by operating the user to an input device such as an operation panel (not illustrated).

When there is no end instruction, the control unit 120 returns to step S1 described above. In contrast, when there is an end instruction, the control unit 120 ends the processing.

As described above, the liquid ejecting apparatus 100 has a liquid ejecting head 10, a circulating mechanism 150, and a control unit 120 which is an example of the "control section". The liquid ejecting head 10 has the plurality of individual flow channels P, the common supply flow channel CF1, the common discharge flow channel CF2, and the bypass flow channels BP1 and BP2. The nozzle N is provided in each of the plurality of individual flow channels P. Through the common supply flow channel CF1, the ink, which is an example of a "liquid", is supplied to the plurality of individual flow channels P. Through the common discharge flow channel CF2, the ink is discharged from the plurality of individual flow channels P. Through the bypass flow channels BP1 and BP2, the individual flow channels P are bypassed, and the common supply flow channel CF1 and the common discharge flow channel CF2 communicate with each other. The circulating mechanism 150 circulates the ink such that the ink supplied from the common supply flow channel CF1 is discharged from the common discharge flow channel CF2 through the plurality of individual flow channels P or the bypass flow channels BP1 and BP2. The control unit 120 controls the operation of the circulating mechanism 150.

Here, during the ejection operation of ejecting the ink from the liquid ejecting head 10, the control unit 120 sets the flow rate of the ink, which is circulated by the circulating mechanism 150, per unit time as the first flow rate. In addition, during the recovery operation of recovering the state of the liquid ejecting head 10, the control unit 120 sets the flow rate of the ink, which is circulated by the circulating mechanism 150, per unit time as the second flow rate which is greater than the first flow rate. As described above, the ejection operation is an operation of ejecting ink from the liquid ejecting head 10. The recovery operation is an operation of recovering the state of the liquid ejecting head 10.

In the above liquid ejecting apparatus, the flow rate per unit time of the ink circulated by the circulating mechanism 150 during the recovery operation is greater than the flow rate during the ejection operation. Therefore, during the ejection operation, the circulating mechanism 150 can be operated to the extent necessary for ejecting the ink from the liquid ejecting head 10 suitably by reducing an increase in viscosity of the ink which greatly affects the ejection characteristics. On the other hand, during the recovery operation, the circulating mechanism 150 can be operated to the extent necessary to recover the state of the liquid ejecting head 10 by removing air bubbles or the like. As described above, since it is only necessary to increase the flow rate of the ink when necessary, it is not necessary to increase the number of pumps used for the circulating mechanism 150 or increase the capacity of the pumps. As a result, it is possible to reduce the increase in viscosity of the ink and remove air bubbles while reducing the cost of the liquid ejecting apparatus.

The control unit 120 sets the flow rate of the ink, which is supplied to the liquid ejecting head 10, per unit period as the third flow rate greater than the first flow rate during the filling operation. Therefore, during the filling operation, the circulating mechanism 150 can be operated to the extent necessary to fill the liquid ejecting head 10 with the ink. As described above, the filling operation is an operation of filling the liquid ejecting head 10 with the ink.

Here, when the third flow rate is equal to or greater than the second flow rate, it is possible to shorten the period necessary for the filling operation and prevent ink from leaking from the nozzle N during the recovery operation.

2. Modification Example

The forms given as examples described above can be variously modified. Specific modified aspects that may be applied to the above-described forms are given as examples below. Two or more embodiments optionally selected from the following examples may be appropriately combined within a scope where the embodiments do not contradict each other.

2-1. Modification Example 1

The above-described embodiment exemplifies a configuration in which the combined flow channel resistance Rs of the bypass flow channels BP1 and BP2 and the plurality of individual flow channels P is greater than the flow channel resistance Rin of the common supply flow channel CF1, but the configuration is not limited to this. Therefore, the combined flow channel resistance Rs of the bypass flow channels BP1 and BP2 and the plurality of individual flow channels P may be equal to or less than the flow channel resistance Rin of the common supply flow channel CF1. However, as described above, it is preferable that the combined flow channel resistance Rs of the bypass flow channels BP1 and BP2 and the plurality of individual flow channels P is greater than the flow channel resistance Rin of the common supply flow channel CF1.

2-2. Modification Example 2

The above-described embodiment exemplifies a configuration in which the combined flow channel resistance Rs of the bypass flow channels BP1 and BP2 and the plurality of individual flow channels P is greater than the flow channel resistance Rout of the common discharge flow channel CF2, but the configuration is not limited to this. Therefore, the combined flow channel resistance Rs of the bypass flow channels BP1 and BP2 and the plurality of individual flow channels P may be equal to or less than the flow channel resistance Rout of the common discharge flow channel CF2. However, as described above, it is preferable that the combined flow channel resistance Rs of the bypass flow channels BP1 and BP2 and the plurality of individual flow channels P is greater than the flow channel resistance Rout of the common discharge flow channel CF2.

2-3. Modification Example 3

The above-described embodiment exemplifies a configuration in which the liquid ejecting head 10 has six head main bodies 14. However, the configuration is not limited to this, and the number of head main bodies 14 included in the liquid ejecting head 10 may be equal to or greater than 1 and equal to or less than 5, or may be equal to or greater than 7.

2-4. Modification Example 4

The above-described embodiment exemplifies a configuration using different types of first ink and second ink. However, the configuration is not limited to this, and the number of types of ink used in the liquid ejecting head 10 may be 1 or may be equal to or greater than 3.

2-5. Modification Example 5

The form of each section of the ink flow channel in the liquid ejecting head 10 is not limited to the above-mentioned form, and may be appropriately changed depending on, for example, disposition of the head main body 14. The holder 13 of each section constituting the flow channel and the flow channel structure 11 may be integrally configured.

2-6. Modification Example 6

The liquid ejecting apparatus 100 exemplified in each of the above-described embodiments can be adopted in various devices such as a facsimile machine and a copier, in addition to an apparatus dedicated to printing. However, the application of the liquid ejecting apparatus of the present disclosure is not limited to printing. For example, a liquid ejecting apparatus that ejects a solution of a coloring material is used as a manufacturing device for forming a color filter of a liquid crystal display device. Further, a liquid ejecting apparatus that ejects a solution of a conductive material is used as a manufacturing device for forming wiring and electrodes on a wiring substrate.

Example

Hereinafter, specific examples of the present disclosure will be described. The present disclosure is not limited to the following examples.

A. Manufacture of Liquid Ejecting Head

A-1. Example 1

The liquid ejecting head having the above-mentioned configurations illustrated in FIGS. 3 to 10 was manufactured. Here, the combined flow channel resistance RCa of the individual supply flow channels included in the plurality of individual flow channels was $6.39\times10^{10}$ [N·s/m$^5$]. The combined flow channel resistance RCb of the individual discharge flow channels included in the plurality of individual flow channels was $6.39\times10^{10}$ [N·s/m$^5$]. The flow channel resistance RBP of the bypass flow channel was $3.12\times10^{10}$ [N·s/m$^5$]. The combined flow channel resistance Rs of the bypass flow channel and the plurality of individual flow channels was $2.51\times10^{10}$ [N·s/m$^5$]. The flow channel resistance Rin of the common supply flow channel was $1.95\times10^{10}$ [N·s/m$^5$]. The flow channel resistance Rout of the common discharge flow channel was $1.12\times10^{10}$ [N·s/m$^5$].

For The flow channel resistances, each value when the total of the combined flow channel resistance Rs, the flow channel resistance Rin, and the flow channel resistance Rout of the common discharge flow channel is 100 is described after rounding off to the first decimal place. The combined flow channel resistance RCa of the individual supply flow channels was 115. The combined flow channel resistance RCb of the individual discharge flow channel was 115. The flow channel resistance RBP of the bypass flow channel was 56. The combined flow channel resistance Rs of the bypass flow channel and the plurality of individual flow channels was 45. The flow channel resistance Rin of the common supply flow channel was 35. The flow channel resistance Rout of the common discharge flow channel was 20.

Here, the combined flow channel resistance RCa+RCb of the combined flow channel resistance RCa of the plurality of individual supply flow channels and the combined flow channel resistance RCb of the plurality of individual discharge flow channels was 229. The individual flow channel P is constituted of an individual supply flow channel and an individual discharge flow channel. Therefore, the combined flow channel resistance RCa+RCb is equal to the combined flow channel resistance RP of the plurality of individual flow channels P. Therefore, the flow channel resistance RBP=56 of the bypass flow channels BP1 and BP2 is less than the combined flow channel resistance RP=229 of the individual flow channel P.

The ratio RBP/(RCa+RCb) of the flow channel resistance RBP of the bypass flow channels BP1 and BP2 to the combined flow channel resistance RP of the plurality of individual flow channels P was 0.24. Therefore, the flow channel resistance RBP of the bypass flow channels BP1 and BP2 is less than 25% as compared with the combined flow channel resistance RP of the individual flow channels P.

A-2. Examples 2 to 15 and Reference Examples 1 to 12

The liquid ejecting heads of Examples 2 to 15 and Reference Examples 1 to 12 were manufactured in a similar manner to the above-mentioned Example 1 except that the combined flow channel resistance RCa, the combined flow channel resistance RCb, the flow channel resistance RBP, the combined flow channel resistance Rs, the flow channel resistance Rin, and the flow channel resistance Rout are set as shown in Table 1.

TABLE 1

| | FLOW CHANNEL RESISTANCE [VALUE IN CASE WHERE (Rs + Rin + Rout) IS SET TO 100] | | | | | | | | EVALUATION | | | |
|---|---|---|---|---|---|---|---|---|---|---|---|---|
| | RCa | RCb | RBP | Rs | Rin | Rout | RCa + RCb | RBP/ (RCa + RCb) | TOTAL FLOW RATE | INCREASE IN VISCOSITY | COMPRE-HENSIVE | OTHERS |
| REFERENCE EXAMPLE 1 | 325 | 325 | 26 | 25 | 55 | 20 | 650 | 0.04 | C | A | B | — |
| REFERENCE EXAMPLE 2 | 240 | 240 | 32 | 30 | 50 | 20 | 480 | 0.07 | C | A | B | — |
| REFERENCE EXAMPLE 3 | 140 | 140 | 40 | 35 | 45 | 20 | 280 | 0.14 | C | A | B | — |
| REFERENCE EXAMPLE 4 | 120 | 120 | 48 | 40 | 40 | 20 | 240 | 0.20 | B | A | B | — |
| EXAMPLE 1 | 115 | 115 | 56 | 45 | 35 | 20 | 229 | 0.24 | A | A | A | B, D, E, F |
| EXAMPLE 2 | 108 | 108 | 65 | 50 | 30 | 20 | 217 | 0.30 | A | A | A | A, B, C, D, E, F |
| EXAMPLE 3 | 107 | 107 | 74 | 55 | 25 | 20 | 214 | 0.35 | A | A | A | A, B, C, D, E, F |
| EXAMPLE 4 | 120 | 120 | 80 | 60 | 20 | 20 | 240 | 0.33 | A | A | A | A, B, C, D, E |
| REFERENCE EXAMPLE 5 | 140 | 140 | 40 | 35 | 50 | 15 | 280 | 0.14 | B | B | B | — |
| REFERENCE EXAMPLE 6 | 140 | 140 | 40 | 35 | 55 | 10 | 280 | 0.14 | A | C | B | — |
| REFERENCE EXAMPLE 7 | 140 | 140 | 40 | 35 | 60 | 5 | 280 | 0.14 | A | C | B | — |
| REFERENCE EXAMPLE 8 | 115 | 115 | 56 | 45 | 45 | 10 | 229 | 0.24 | B | B | B | — |

TABLE 1-continued

| | FLOW CHANNEL RESISTANCE [VALUE IN CASE WHERE (Rs + Rin + Rout) IS SET TO 100] | | | | | | | RBP/ | EVALUATION | | | |
|---|---|---|---|---|---|---|---|---|---|---|---|---|
| | RCa | RCb | RBP | Rs | Rin | Rout | RCa + RCb | (RCa + RCb) | TOTAL FLOW RATE | INCREASE IN VISCOSITY | COMPRE-HENSIVE | OTHERS |
| REFERENCE EXAMPLE 9 | 115 | 115 | 56 | 45 | 50 | 5 | 229 | 0.24 | A | C | B | — |
| REFERENCE EXAMPLE 10 | 240 | 240 | 32 | 30 | 40 | 30 | 480 | 0.07 | C | A | B | — |
| REFERENCE EXAMPLE 11 | 240 | 240 | 32 | 30 | 60 | 10 | 480 | 0.07 | C | A | B | — |
| REFERENCE EXAMPLE 12 | 240 | 240 | 32 | 30 | 65 | 5 | 480 | 0.07 | C | A | B | — |
| EXAMPLE 5 | 120 | 120 | 80 | 60 | 35 | 5 | 240 | 0.33 | A | A | A | A, B, C, D, E, F |
| EXAMPLE 6 | 120 | 120 | 80 | 60 | 5 | 35 | 240 | 0.33 | A | A | A | A, B, C, D, E |
| EXAMPLE 7 | 90 | 90 | 60 | 45 | 35 | 20 | 180 | 0.33 | A | A | A | B, C, D, E, F |
| EXAMPLE 8 | 63 | 63 | 70 | 45 | 35 | 20 | 126 | 0.56 | A | A | A | B, E, F |
| EXAMPLE 9 | 51 | 51 | 80 | 45 | 35 | 20 | 103 | 0.78 | A | A | A | B, E, F |
| EXAMPLE 10 | 45 | 45 | 90 | 45 | 35 | 20 | 90 | 1.00 | A | A | A | E, F |
| EXAMPLE 11 | 41 | 41 | 100 | 45 | 35 | 20 | 82 | 1.22 | A | A | A | E, F |
| EXAMPLE 12 | 100 | 140 | 80 | 60 | 20 | 20 | 240 | 0.33 | A | A | A | A, B, C, D |
| EXAMPLE 13 | 110 | 130 | 80 | 60 | 20 | 20 | 240 | 0.33 | A | A | A | A, B, C, D |
| EXAMPLE 14 | 130 | 110 | 80 | 60 | 20 | 20 | 240 | 0.33 | A | A | A | A, B, C, D |
| EXAMPLE 15 | 140 | 100 | 80 | 60 | 20 | 20 | 240 | 0.33 | A | A | A | A, B, C, D |

B. Evaluation

B-1. Evaluation of Flow Rate

The ink flow rate in the entire flow channel of the liquid ejecting head was evaluated according to the following criteria.

A: The ink flow rate is appropriate.

B: The ink flow rate is slightly high.

C: The ink flow rate is excessive.

The evaluation result is as described in the column of "total flow rate" shown in Table 1.

B-2. Evaluation of Increase in Viscosity

The increase in viscosity of the ink near the nozzle of the liquid ejecting head was evaluated according to the following criteria.

A: No increase in viscosity occurs.

B: There is no problem in actual use, but there is a tendency for increase in viscosity.

C: The increase in viscosity occurs, which is problematic in actual use.

The evaluation results are as described in the column of "increase in viscosity" shown in Table 1.

B-3. Comprehensive Evaluation

Comprehensive evaluation of the above-mentioned flow rate and the increase in viscosity evaluation was performed according to the following criteria.

A: There is no problem in the evaluation of both the flow rate and the increase in viscosity.

B: There is a problem in evaluating at least one of the flow rate and the increase in viscosity.

The evaluation results are as described in the "Comprehensive" column shown in Table 1.

B-4. Other Evaluations

Other evaluations of the examples were performed according to the following criteria.

A: The balance between the viscosity of the ink and the flow rate is particularly excellent.

B: It is preferable to achieve both the nozzle density and the total flow rate of the ink.

C: It is more preferable to achieve both the nozzle density and the total flow rate of the ink.

D: The total flow rate of ink is particularly low.

E: The variation between the two pressure chambers is reduced.

F: Both foreign matter collection and cost reduction are achieved.

The evaluation results are as described in the "Others" column shown in Table 1. It should be noted that the evaluation may meet a plurality of criteria, and the larger the number of criteria to be met, the more favorable the evaluation.

As can be seen from the results shown in Table 1, excellent results were obtained in each example as compared with each reference example. Similar results were obtained for each of the ejection operation, recovery operation, and filling operation. Here, it was confirmed that when the flow rate of the ink per unit time was made greater than the flow rate of the ejection operation in each of the recovery operation and the filling operation, air bubbles in the flow channel could be suitably removed.

What is claimed is:

1. A liquid ejecting apparatus comprising:

a liquid ejecting head that has a plurality of individual flow channels provided with nozzles, a common supply flow channel through which a liquid is supplied to the plurality of individual flow channels, a common discharge flow channel through which the liquid is discharged from the plurality of individual flow channels, and a bypass flow channel that bypasses the plurality of individual flow channels and causes the common supply flow channel and the common discharge flow channel to communicate with each other;

a circulating mechanism that circulates the liquid, which is supplied from the common supply flow channel, so as to discharge the liquid from the common discharge flow channel through the plurality of individual flow channels or the bypass flow channel; and a control section that controls an operation of the circulating mechanism, wherein the control section sets, as a first flow rate, a flow rate of the liquid, which is circulated by the circulating mechanism, per unit time, during an ejection operation of ejecting the liquid from the liquid ejecting head, and sets, as a second flow rate greater than the first flow rate, a flow rate of the liquid, which is circulated by the circulating mechanism, per unit time, during a recovery operation of recovering a state of the liquid ejecting head.

2. The liquid ejecting apparatus according to claim 1, wherein the control section sets, as a third flow rate greater than the first flow rate, a flow rate of the liquid, which is supplied to the liquid ejecting head, per unit period, during a filling operation of filling the liquid ejecting head with the liquid.

3. The liquid ejecting apparatus according to claim 2, wherein the third flow rate is equal to or greater than the second flow rate.

4. A liquid ejecting apparatus comprising:

a liquid ejecting head that has a plurality of individual flow channels provided with nozzles, a common supply flow channel through which a liquid is supplied to each of the plurality of individual flow channels, a common discharge flow channel through which the liquid is discharged from each of the plurality of individual flow channels, and a bypass flow channel that bypasses the plurality of individual flow channels and causes the common supply flow channel and the common discharge flow channel to communicate with each other;

a circulating mechanism that circulates the liquid, which is supplied from the common supply flow channel, so as to discharge the liquid from the common discharge flow channel through the plurality of individual flow channels or the bypass flow channel; and a control section that controls an operation of the circulating mechanism, wherein the control section sets, as a first flow rate, a flow rate of the liquid, which is circulated by the circulating mechanism, per unit time, during an ejection operation of ejecting the liquid from the liquid ejecting head, and sets, as a third flow rate greater than the first flow rate, a flow rate of the liquid, which is supplied to the liquid ejecting head, per unit period, during a filling operation of filling the liquid ejecting head with the liquid.

5. The liquid ejecting apparatus according to claim 1, wherein a combined flow channel resistance of the bypass flow channel and the plurality of individual flow channels is greater than a flow channel resistance of the common supply flow channel and is greater than a flow channel resistance of the common discharge flow channel.

6. The liquid ejecting apparatus according to claim 1, wherein a flow channel resistance of the bypass flow channel is less than a combined flow channel resistance of the plurality of individual flow channels.

7. The liquid ejecting apparatus according to claim 1, wherein when a direction in which the liquid is ejected from the nozzles is defined as a first direction, a direction orthogonal to the first direction is defined as a second direction, and a direction orthogonal to both the first direction and the second direction is defined as a third direction, the bypass flow channel has a first portion which extends along the first direction and is coupled to the common supply flow channel, a second portion which extends along the first direction and is coupled to the common discharge flow channel, and a third portion which extends along a plane parallel to both the second direction and the third direction and is coupled to each of the first portion and the second portion.

8. The liquid ejecting apparatus according to claim 7, wherein the third portion has a U-shape as viewed in the first direction.

9. The liquid ejecting apparatus according to claim 7, wherein a flow channel resistance of each of the first portion and the second portion is greater than a flow channel resistance of the third portion.

* * * * *